US009091976B2

(12) United States Patent
Kikkawa

(10) Patent No.: US 9,091,976 B2
(45) Date of Patent: Jul. 28, 2015

(54) IMAGE HEATING APPARATUS

(75) Inventor: Naoya Kikkawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 393 days.

(21) Appl. No.: 13/592,960

(22) Filed: Aug. 23, 2012

(65) Prior Publication Data

US 2013/0058673 A1 Mar. 7, 2013

(30) Foreign Application Priority Data

Sep. 1, 2011 (JP) ..... 2011-190763

(51) Int. Cl.
*G03G 15/20* (2006.01)

(52) U.S. Cl.
CPC ..... *G03G 15/2042* (2013.01); *G03G 15/206* (2013.01)

(58) Field of Classification Search
CPC ..... G03G 15/2017; G03G 15/2039; G03G 15/2042; G03G 15/2078
USPC ..... 399/45, 69, 70, 329
See application file for complete search history.

(56) References Cited

U.S. PATENT DOCUMENTS

| | | | | |
|---|---|---|---|---|
| 6,047,158 | A * | 4/2000 | Morigami et al. | 399/328 |
| 7,925,198 | B2 | 4/2011 | Urano | |
| 2003/0077093 | A1 * | 4/2003 | Sekiguchi | 399/328 |
| 2009/0317152 | A1 | 12/2009 | Urano | |

FOREIGN PATENT DOCUMENTS

| | | | |
|---|---|---|---|
| JP | 2004309651 | A * | 11/2004 |
| JP | 2009237402 | A * | 10/2009 |
| JP | 2010-002488 | A | 1/2010 |
| JP | 2011022356 | A * | 2/2011 |

OTHER PUBLICATIONS

Complete English Translation of Japanese Patent Application No. 2011-22356, dated Feb. 3, 2011.
Complete English Translation of Japanese Patent Application No. 2004-309651, dated Nov. 4, 2004.

* cited by examiner

*Primary Examiner* — Erika J Villaluna
(74) *Attorney, Agent, or Firm* — Fitzpatrick, Cella, Harper & Scinto

(57) ABSTRACT

Provided is a fixing apparatus that can satisfy a quick start property while preventing degradation of paper non-passing sections of a fixing belt due to heat. In continuous image formation on a plurality of small-sized papers, if a temperature of the fixing belt at the reception of an execution command of a job is lower than a predetermined temperature, a heat equalizing roller is abutted to a pressure roller when an increase in the temperature of the paper non-passing sections of the fixing belt is feared along with progress of the job to thereby guarantee the quick start property. On the other hand, if the temperature of the fixing belt is higher than the predetermined temperature, the heat equalizing roller is abutted to the pressure roller from the beginning to suppress an increase in the temperature of the paper non-passing sections of the fixing belt.

21 Claims, 20 Drawing Sheets

IMAGE HEATING APPARATUS

BACKGROUND OF THE INVENTION

1. Field of the Invention

The present invention relates to an image heating apparatus that heats an image on a recording material. The image heating apparatus can be used in an image forming apparatus, such as a copy machine, a printer, a facsimile machine and a complex machine with a plurality of functions of these devices.

2. Description of the Related Art

Conventionally, an image forming apparatus, such as a copying machine, includes a fixing apparatus (image heating apparatus) that fixes a toner image formed on recording paper (recording material). In recent years, quick start of printing, more specifically, quick completion of image formation on a first recording paper after reception of a print command (quick start property), is demanded. Therefore, the heat capacity of a fixing member (endless belt) is reduced.

When the fixing member with reduced heat capacity is used, the temperature of an area as a paper non-passing section of the fixing member may be excessively increased in a fixing process (image heating process) on recording paper narrower than recording paper with a maximum width that can be used for the apparatus.

For handling the problem, although the fixing member with reduced heat capacity is not used, an apparatus described in Japanese Patent Application Laid-Open No. 2010-002488 includes a heat pipe (heat absorption rotary member) arranged in contact with a pressure roller. Specifically, the apparatus described in Japanese Patent Application Laid-Open No. 2010-002488 uses a heat transport function in a direction of axis of the heat pipe to equalize a temperature distribution in the direction of axis of the pressure roller. In this way, an attempt is made to indirectly prevent an increase in the temperature of the paper non-passing section of the fixing roller.

However, if the heat pipe is continuously in contact with the pressure roller as in the apparatus described in Japanese Patent Application Laid-Open No. 2010-002488, it is difficult to increase the temperature of the fixing roller and the pressure roller to a desired fixing temperature in a short time. More specifically, the time required for warm-up of the fixing apparatus is long, and quick start of printing is difficult. This is because the heat capacity of the heat pipe arranged to handle the increase in the temperature of the paper non-passing section is large, and the heat capacity cannot be ignored. More specifically, heat flows to the heat pipe through the pressure roller during warm-up, and the fixing roller and the pressure roller are in a relationship in which an increase in the temperature to the desired fixing temperature is difficult.

SUMMARY OF THE INVENTION

An object of the present invention is to provide an image heating apparatus that can suppress an excessive increase in the temperature of part of an endless belt in an image heating process, without losing a quick start property.

An image heating apparatus as an example of the present invention includes: an endless belt that heats a toner image on a recording material at a nip section; a heater that heats the endless belt; a drive rotary member that forms the nip section with the endless belt and that rotationally drives the endless belt; a heat absorption rotary member that absorbs heat from the drive rotary member by abutment with the drive rotary member; a contact and separation mechanism that contacts the heat absorption rotary member with the drive rotary member and separates the heat absorption rotary member from the drive rotary member; and a controller that controls operation of the contact and separation mechanism, when continuously applying an image heating process to a plurality of recording materials narrower than a recording material with a maximum width that can be used for the image heating apparatus, the controller configured to execute a first mode for abutting the heat absorption rotary member to the drive rotary member after a predetermined number of the recording materials have passed through the nip section, and to execute a second mode for abutting the heat absorption rotary member to the drive rotary member before a first recording material reaches the nip section.

An image heating apparatus as an example of the present invention includes: an endless belt that heats a toner image on a recording material at a nip section; a heater that heats the endless belt; a drive rotary member that forms the nip section with the endless belt and that rotationally drives the endless belt; a heat absorption rotary member that absorbs heat from the drive rotary member by abutment with the drive rotary member; a contact and separation mechanism that contacts the heat absorption rotary member with the drive rotary member and separates the heat absorption rotary member from the drive rotary member; and a controller that controls operation of the contact and separation mechanism, when continuously applying an image heating process to a plurality of recording materials narrower than a recording material with a maximum width that can be used for the image heating apparatus, the controller configured to execute a first mode for abutting the heat absorption rotary member to the drive rotary member after warm-up processing, and to execute a second mode for causing the heat absorption rotary member to be in a state where the heat absorption rotary member abuts to the drive rotary member during the warm-up processing.

An image heating apparatus as an example of the present invention includes: an endless belt that heats a toner image on a recording material at a nip section; a heater that heats the endless belt; a drive rotary member that forms the nip section with the endless belt and that rotationally drives the endless belt; a temperature sensor that detects temperature of the endless belt; a heat absorption rotary member that absorbs heat from the drive rotary member by abutment with the drive rotary member; a contact and separation mechanism that contacts the heat absorption rotary member with the drive rotary member and separates the heat absorption rotary member from the drive rotary member; and a controller that controls operation of the contact and separation mechanism, when continuously applying an image heating process to a plurality of recording materials narrower than a recording material with a maximum width that can be used for the image heating apparatus, the controller configured to execute a first mode for controlling timing of abutting the heat absorption rotary member to the drive rotary member according to output of the temperature sensor, and to execute a second mode for abutting the heat absorption rotary member to the drive rotary member before a first recording material reaches the nip section.

Other objects of the present invention will become apparent by referring to the following detailed description with reference to the attached drawings.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Embodiments of the present invention will now be described in detail with reference to the drawings. Embodiments of the present invention applied to an electrophotographic color copying machine including a plurality of drums will be described. However, they are not limited to this and can also be applied to electrophotographic copying machines of various systems, printers, mono-color systems, or image forming apparatuses that are not electrophotographic apparatuses.

First Embodiment

(1) Example of Image Forming Apparatus

Figure 1:
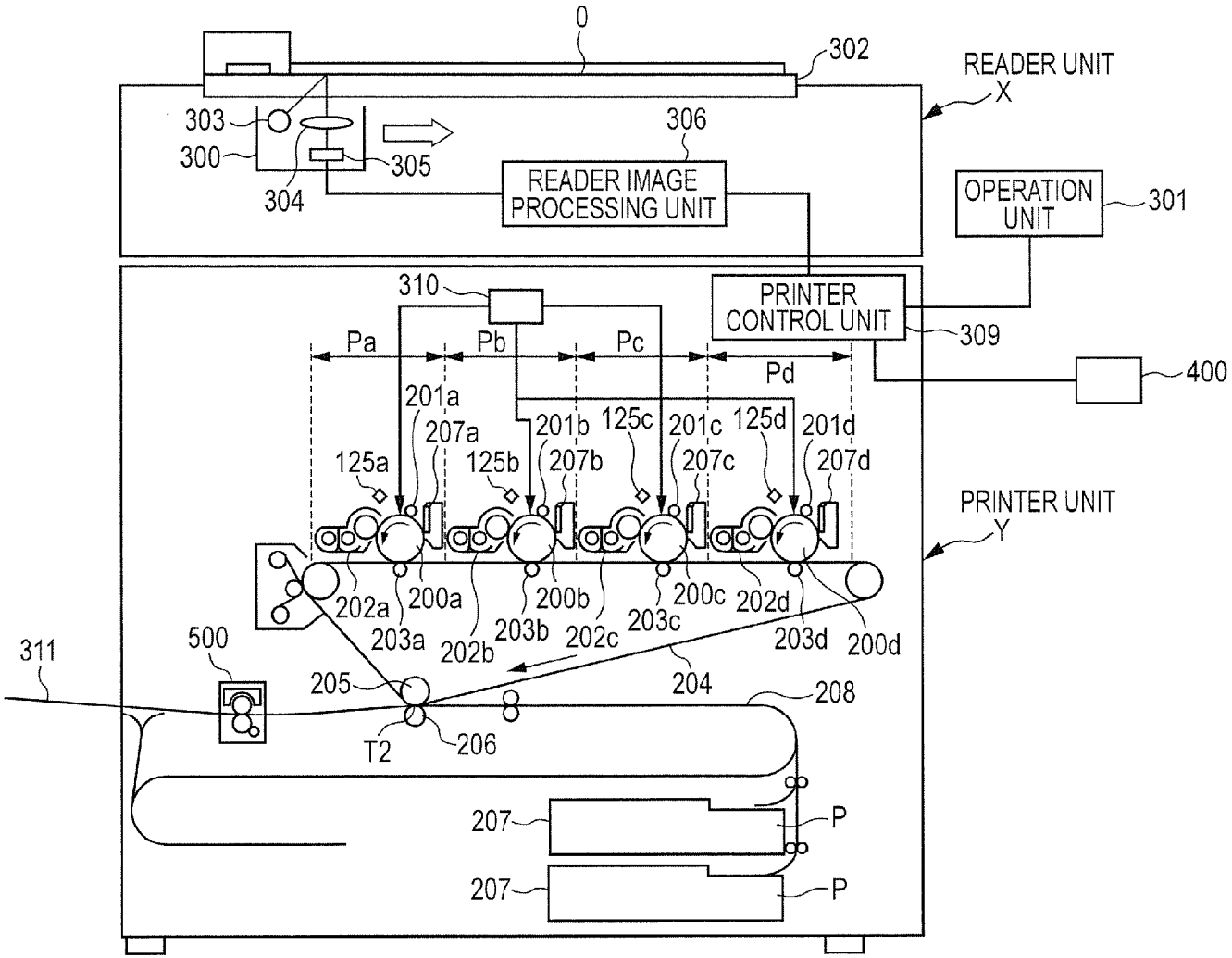
FIG. 1 is a schematic configuration diagram of an example of an image forming apparatus according to a first embodiment.

FIG. 1 is a schematic configuration diagram of an example of an electrophotographic color copying machine including a fixing apparatus 500 as an image heating apparatus according to the present invention.

A full-color image formation operation will be described. A mobile reading optical system unit 300 applies color-separation photoelectric reading to an image surface of a color document O which is set on an original table glass 302 of a reader unit X, wherein the image surface faces downward. The unit 300 moves forward to the right as illustrated by an arrow, from a home position on the left side along the lower surface of the glass 302. After moving forward for a predetermined distance, the unit 300 moves backward to return to the original home position.

The image surface of the document O facing downward is radiated by a light source 303 in the process of the forward movement of the unit 300. A CCD sensor 305 forms an image through an optical system 304, and color-separation photoelectric reading is applied to the image. In this way, the original image is converted to electric signal data strings of each line.

An image signal obtained by the sensor 305 is transmitted to a printer control unit (control circuit) 309 of a printer unit Y through a reader image processing unit 306, and image processing is applied according to the print. The control unit 309 can also receive, as an image signal, an external input from an external host apparatus 400 such as a print server. The control unit 309 converts the image signal to a PWM laser beam. A polygon scanner 310 scans and irradiates electrophotographic photosensitive drums 200*a* to 200*d* of four image forming units Pa to Pd with the beam. The drums 200*a* to 200*d* are rotationally driven in a counterclockwise direction as illustrated by arrows, at a predetermined speed.

The image forming apparatus of the present embodiment includes an image forming device that forms toner images on a recording paper (recording material), and a fixing apparatus (image heating apparatus) that fixes the toner images formed on the recording paper.

The image forming device will be described first. Image forming units Pa, Pb, Pc and Pd are electrophotographic image formation units that form toner images (unfixed images) of yellow (Y), magenta (M), cyan (C) and black (Bk) on drums 200*a*, 200*b*, 200*c* and 200*d*, respectively. Since the image forming units Pa to Pd are substantially the same, details of the image forming unit Pa of Y will be described, and the other image forming units Pb, Pc and Pd will not be described.

In the image forming unit Pa of Y, a primary charger 201*a* charges the surface of the rotationally driven drum 200*a* at a predetermined potential. The surface is exposed by a beam from the scanner 310, and an electrostatic latent image is formed. A development device 202*a* develops the latent image to a toner image (developer image) of Y. The primary transfer roller 203*a* primarily transfers the toner image to an intermediate transfer belt 204.

The belt 204 circulates in a clockwise direction as illustrated by an arrow, at the same speed as the speed of the drum 200*a*. A primary transfer bias with a polarity opposite the toner is applied to the roller 203*a*, and the electricity is discharged from the back side of the belt 204. In this way, the image is sequentially transferred from the drum 200*a* to the belt 204. A cleaner 207*a* cleans the surface of the drum 200*a* after the image transfer to the belt 204.

Continuous movement of the belt 204 sequentially conveys the toner image on the belt 204 to the following image forming units Pb, Pc and Pd, and toner images are superimposed and transferred in the order of M, C and Bk. After passing through the image forming unit Pd, overlapping images of four colors of Y, M, C and Bk are ultimately synthesized and formed on the belt 204. A secondary transfer unit (nip section) T2 including a secondary transfer inner roller 205 and an outer roller 206 secondarily transfers the images on the belt 204 all together from the belt 204 to recording paper (recording material) P. A cleaner 209 cleans the surface of the drum 200*a* after the image transfer to the recording paper P.

The recording paper P is separated and fed piece by piece from a paper feeding cassette 207. A sheet path 208 guides the recording paper P to a nip section of the belt 204 and the outer roller 206 of the secondary transfer unit T2 at predetermined control timing, and the recording paper P is sandwiched and conveyed. The toner images on the belt 204 are electrostatically transferred to the recording paper P by a secondary transfer electric field with a polarity opposite the toners applied between the rollers 205 and 206.

The recording paper P output from the secondary transfer unit T2 is separated from the surface of the belt 204 and delivered to the fixing apparatus 500. The fixing apparatus 500 heats and pressures the unfixed toner images on the recording paper to fix as a fixed image. The recording paper P exits the fixing apparatus 500 and is discharged to a discharge unit 311 as an image formed material.

(2) Fixing Apparatus 500

The fixing apparatus will be described. In the following description, a longitudinal direction of the fixing apparatus 500 or of members included in the fixing apparatus 500 denotes a direction of axis of the rotary member (thrust direction), a direction orthogonal to a recording paper conveyance direction in a recording paper conveyance path, or a direction parallel to the direction. A lateral direction denotes a direction parallel to the recording paper conveyance direction. A width direction of the fixing belt (endless belt) denotes a direction parallel to the direction orthogonal to the recording paper conveyance direction. A width direction length (size) of the recording paper denotes a length (size) in a direction substantially parallel to the width direction of the fixing belt.

Regarding the fixing apparatus, a front side denotes a side viewing the apparatus from a recording paper entrance side, and a back side denotes a side opposite the front side (recording paper exit side). Left and right denote left and right when viewing the apparatus from the front side. Up and down denote up and down in the direction of gravitational force. Upstream and downstream denote upstream and downstream in the recording paper conveyance direction. A recording paper size (paper size) or a paper passing width of the recording paper denotes a recording paper dimension (width size) in a direction orthogonal to the recording paper conveyance direction on the recording paper surface.

Figure 2:
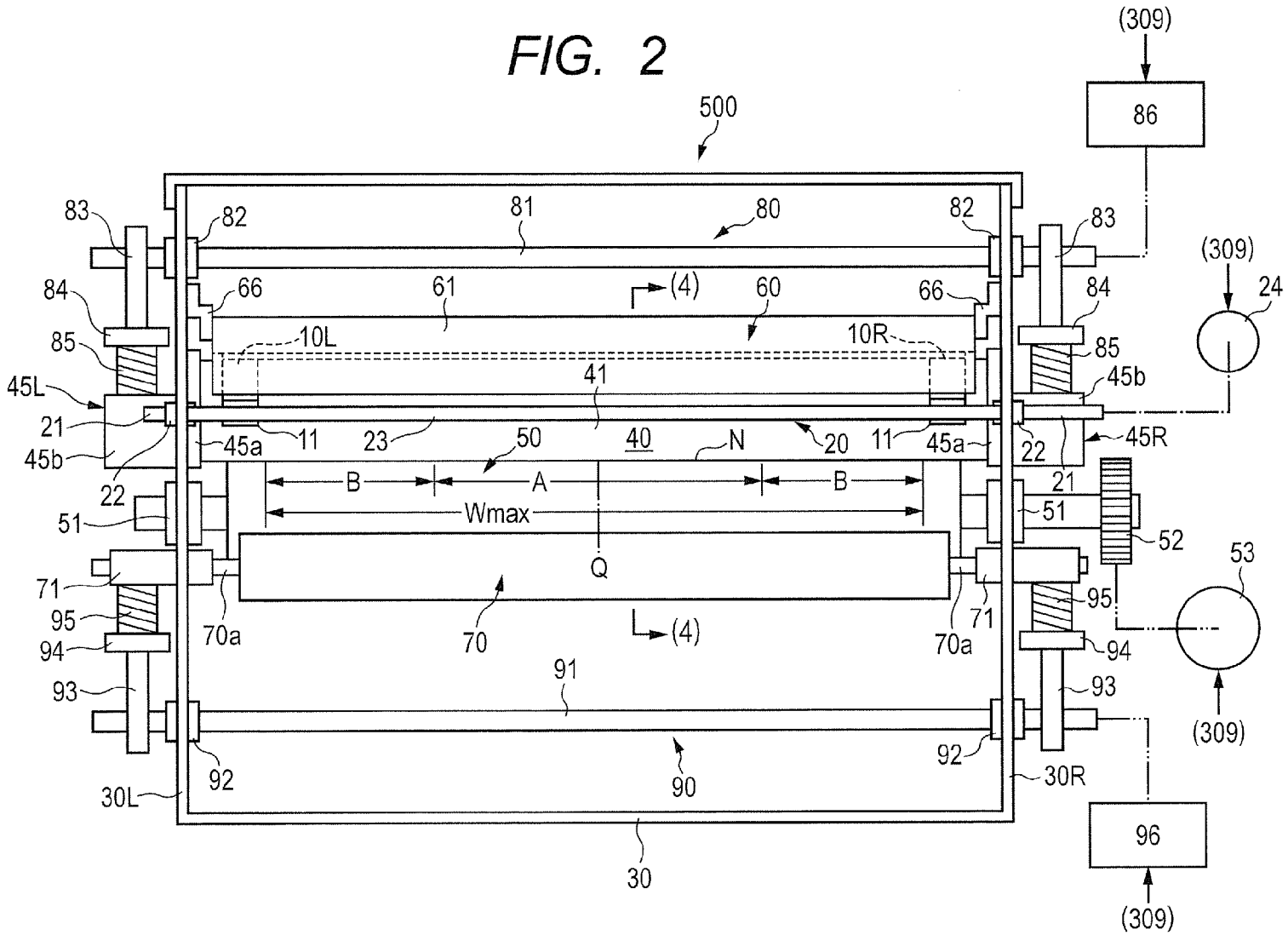
FIG. 2 is a front schematic diagram of main parts of a mounted fixing apparatus (image heating apparatus).
Figure 3:
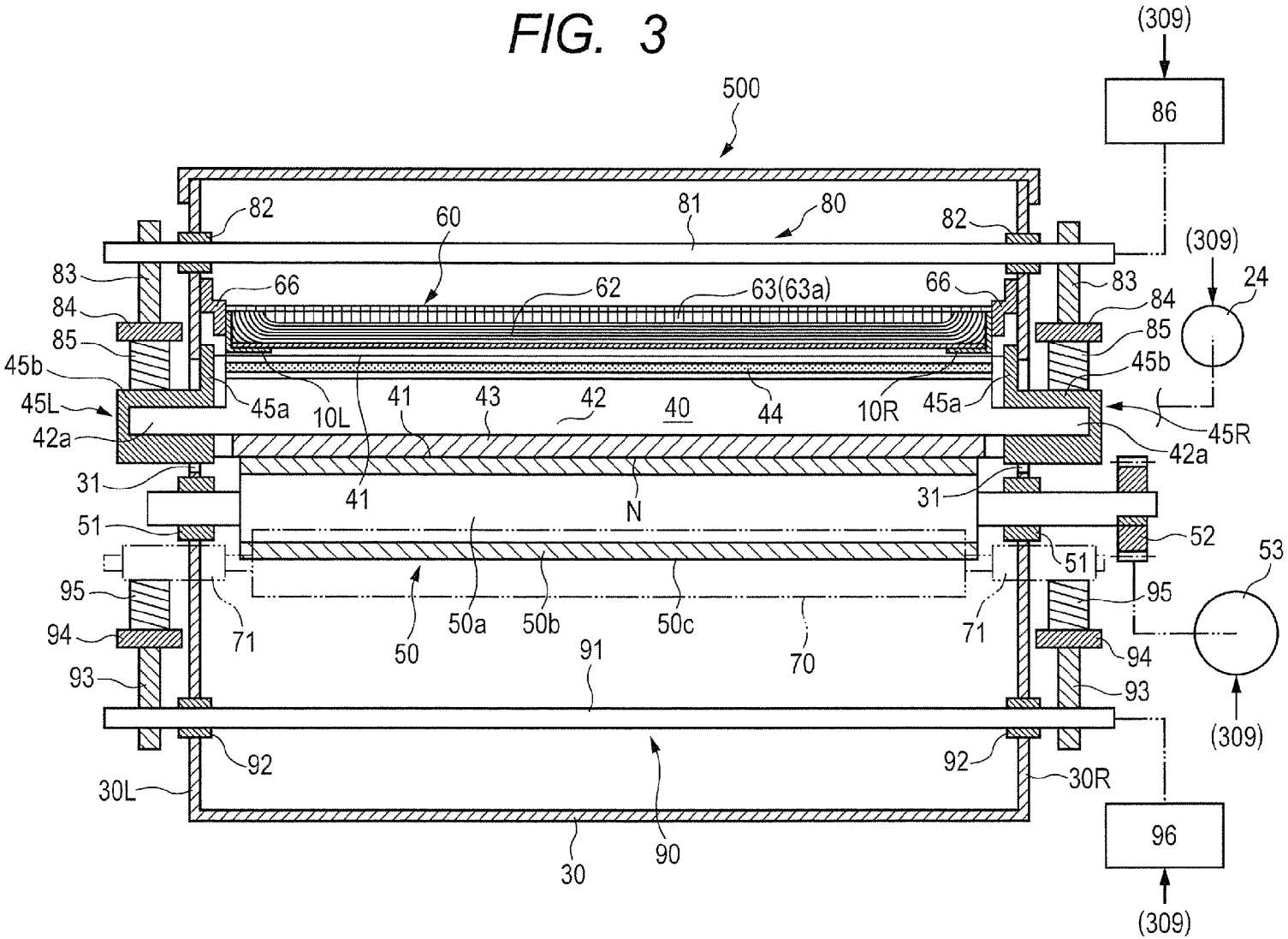
FIG. 3 is a longitudinal sectional front schematic diagram of main parts of the fixing apparatus.
Figure 4:
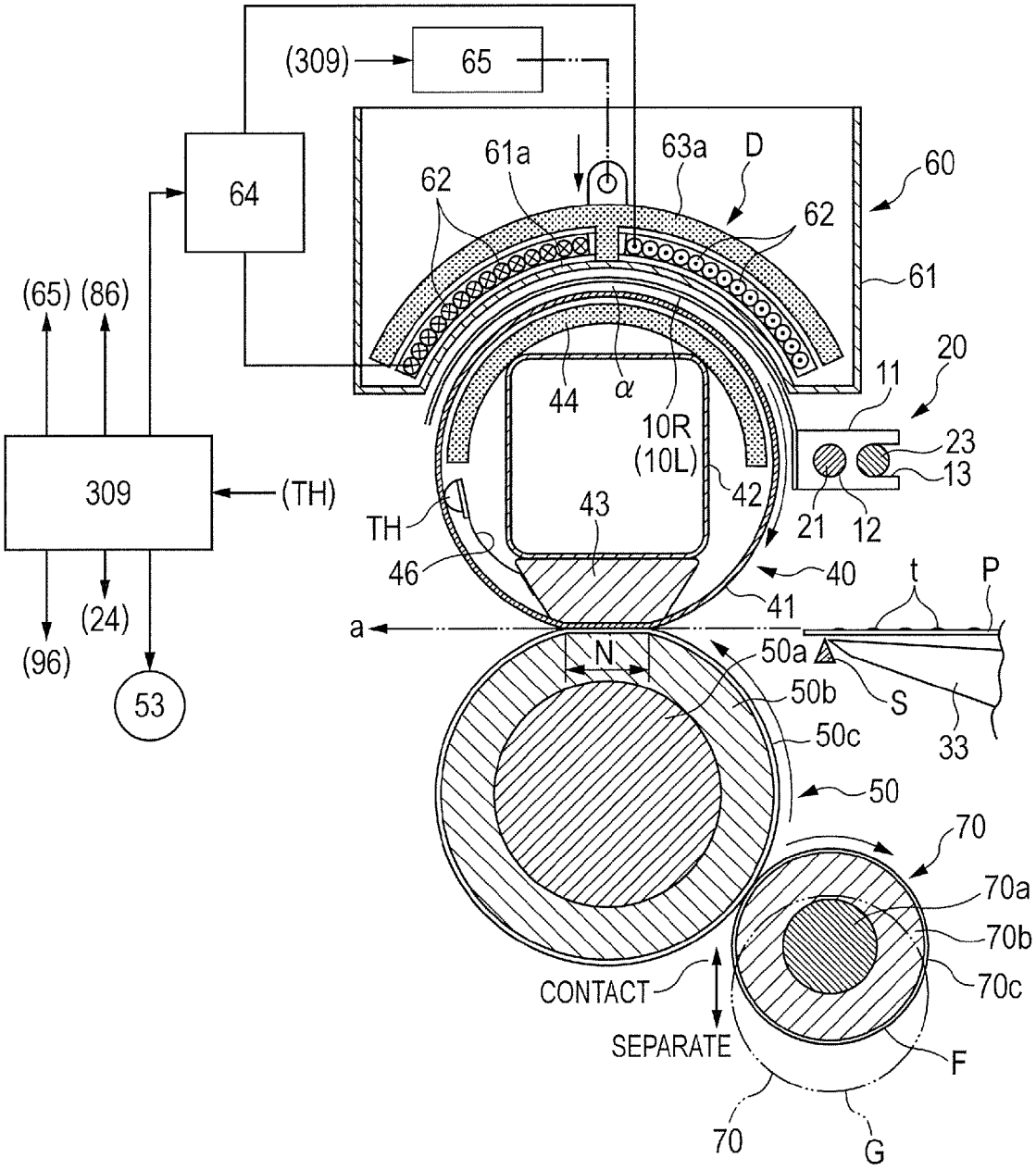
FIG. 4 is an enlarged right side view along a (4)-(4) line of FIG. 2.

FIG. 2 is a front schematic diagram of main parts of the fixing apparatus 500. FIG. 3 is a longitudinal sectional front schematic diagram of main parts of the apparatus 500. FIG. 4 is an enlarged right side view along a (4)-(4) line of FIG. 2.

The fixing apparatus 500 is an image heating apparatus of an external-heating electromagnetic induction heating system including a magnetic field generation unit outside of a heating member. The apparatus 500 includes a heating assembly 40 including an image heating member (heating rotary member) 41, and an elastic pressure roller as a pressure member (pressure rotary member). The fixing apparatus 500 further includes: a coil unit (induction heating apparatus) 60 as a magnetic field generation unit (heater); magnetic flux shielding plates (magnetic flux shielding members) 10L and 10R; and a heat equalizing roller 70. The fixing apparatus 500 further includes: a pressuring/pressure releasing mechanism 80 of the heating assembly 40 relative to the pressure roller 50; a shift mechanism 20 of the magnetic flux shielding plates 10L and 10R; and a shift mechanism 90 of the heat equalizing roller 70.

The assembly 40, the roller 50, the unit 60, the members 10L and 10R, the roller 70, and the various mechanisms 80, 20 and 90 are arranged on a left side plate 30L and a right side plate 30R of an apparatus chassis 30 of the apparatus 500.

(2-1) Heating Assembly 40

The assembly 40 includes a cylindrical fixing belt (endless belt) 41 as a rotatable image heating member formed by magnetic members (metallic layer, conductive member) that generate heat by electromagnetic induction when an area with a field (magnetic field) generated from the coil unit 60 is passed. The assembly 40 further includes a metallic stay 42 inserted into the belt 41. A pressure pad 43 as a pressure applying member is attached to the lower surface of the stay 42 along the longitudinal direction.

The pad 43 is a member that applies predetermined pressurizing forth between the belt 41 and the pressure roller 50 to form a fixing unit (fixing nip section) N and is made of a heat-resistant resin. The stay 42 needs to be rigid to apply pressure to the nip section N. Therefore, the stay 42 is made of iron in the present embodiment. A magnetic shielding core (inner magnetic core) 44 as a magnetic shielding member for preventing an increase in the temperature as a result of induction heat of the metallic stay 42 by an effect of the magnetic field generated from the unit 60 is arranged on the upper surface side of the stay 42 along the longitudinal direction of the stay 42.

Extended arms 42*a* are arranged on both left and right end sections of the stay 42, and the arms 42*a* project outward from both left and right end sections of the belt 41. Symmetric flange members 45L and 45R are respectively fitted to the left and right arms 42*a*, respectively. The belt 41 is loosely fit onto a compound of the stay 42, the pad 43 and the core 44. Inward surfaces of flange units 45*a* of the left flange member 45L and the right flange member 45R restrict the movement of the belt 41 in the longitudinal direction (left and right direction).

As described later, a base layer 41*a* of the belt is formed by metal that generates heat by electromagnetic induction. Therefore, to restrict the rotating belt 41 from shifting in the width direction, the arrangement of the flange members 45L and 45R including the flange units 45*a* for simply stopping the edges of the belt is sufficient. This is advantageous that the configuration of the fixing apparatus 500 can be simplified.

At the center section in the longitudinal direction of the pad 43, a temperature sensor TH, such as a thermistor, is arranged through an elastic support member 46 as a temperature detection unit (temperature detection element) that detects the temperature of the belt 41. The sensor TH elastically abuts onto the inner surface of the belt 41 by the member 46. In this way, even if there is a positional change, such as undulation of the sensor abutting surface of the rotating belt 41, the sensor TH follows the change to maintain an excellent contact state with the inner surface of the belt 41.

In the assembly 40, pressure receiving units 45*b* of the left flange member 45L and the right flange member 45R are respectively engaged to vertical guide slit units arranged on the side plates 30L and 30R, between the left side plate 30L and the right and side plate 30R. Therefore, the assembly 40 has a degree of freedom movable in the up and down direction along the slit units 31 between the left side plate 30L and the right side plate 30R.

Figure 6:
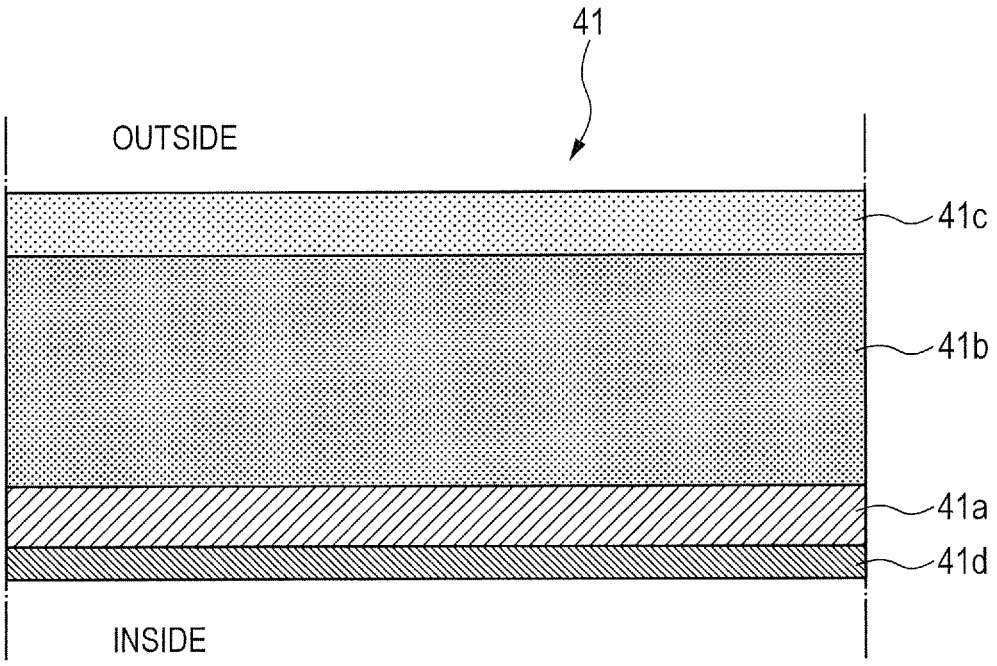
FIG. 6 is a schematic layer configuration diagram of a fixing belt (heating member).

FIG. 6 is a schematic diagram illustrating a layer configuration of the belt 41. In the present embodiment, the belt 41 includes a nickel base layer (magnetic member, metallic layer) 41*a* manufactured by electroforming, and an internal diameter is 30 mm. The thickness of the base layer 41*a* is 40 μm. A heat-resistance silicone rubber layer as an elastic layer 41*b* is arranged on the outer periphery of the base layer 41*a*. The thickness of the layer 41*b* can be set within a range of 100 to 1000 μm.

In the present embodiment, the thickness of the layer 41*b* is 300 μm in order to reduce the heat capacity of the belt 41 to reduce the time required for warm-up processing and to obtain a preferred fixing image when the color image is fixed. The warm-up processing denotes preparatory operation after receiving a print command for transition to a state (rise to a target temperature that allows fixing) in which a fixing process (image heating process) can be executed in response to the print command.

The silicone rubber of the layer 41*b* has a hardness of JIS-A 20 degrees, and a thermal conductivity is 0.8 W/mK. A fluorine resin layer (for example, PFA or PTFE) as a surface releasing layer 41*c* with a thickness of 30 μm is further arranged on the outer periphery of the layer 41*b*.

To reduce sliding friction of the inner surface of the belt and the sensor TH1, a resin layer (lubricating layer) 41*d*, such as a fluorine resin and polyimide, with a thickness of 10 to 50 μm may be arranged on the inner surface side of the base layer 41*a*. In the present embodiment, 20 μm of polyimide is arranged as the layer 41*d*.

The belt 41 as a whole has a low heat capacity and is flexible (elastic). The belt 41 holds a cylindrical shape in a free state. Other than nickel, a metal, such as an iron alloy, copper and silver, can be appropriately selected for the metallic layer 41*a* of the belt 41. The metals can be laminated over a resin base layer. The thickness of the metallic layer 41*a* can be adjusted according to the frequency of a high-frequency current applied to an exciting coil (magnetic field generation coil) 62, described later, of the unit 60 and according to the permeability and electric conductivity of the metallic layer 41*a*. The thickness may be set between about 5 to 200 μm.

(2-2) Pressure Roller 50

The pressure roller 50 as a pressure member (drive rotary member) is rotatably arranged below the assembly 40, between the left side plate 30L and the side plate right 30R and through a bearing 51, wherein the direction of axis is substantially parallel to the longitudinal direction of the assembly 40.

In the present embodiment, the pressure roller 50 is an elastic roller including a silicone rubber layer as an elastic layer 50*b* arranged on a cored bar 50*a* made of an iron alloy with a diameter of 20 mm at the center section in the longitudinal direction and a diameter of 19 mm at both end sections, wherein the outer diameter of the elastic roller is 30 mm. On the surface, a fluorine resin layer (for example, PFA or PTFE) as a releasing layer 50*c* is arranged with a thickness of 30 μm. The hardness at the center section in the longitudinal direction of the pressure roller 50 is ASK-C 70 degrees. The reason that the cored bar 50*a* has a taper shape is to equalize, in the longitudinal direction, the pressure in the fixing nip section N formed by pressure contacting of the belt 41 and the pressure roller 50 even if the pad 43 is bent when pressured.

A drive gear 52 is fixed and arranged on an edge on the right side of the cored bar 50*a*. Driving force of a fixing motor 53 controlled by the control unit 309 is transmitted to the gear 52 through a transmission unit (not illustrated), and the pressure roller 50 is rotationally driven in a counterclockwise direction as illustrated by an arrow in FIG. 4, at a predetermined speed. The motor 53 rotationally drives the pressure roller 50, and therefore, the fixing belt 41 rotates following the pressure roller 50 when the fixing belt 41 is pressure contacted against the pressure roller 50. That is, the pressure roller 50 has a function for rotationally driving the fixing belt 41.

(2-3) Pressure Releasing Mechanism 80

A cam shaft 81 is rotatably arranged on the left side plate 30L and the right side plate 30R through bearings 81 and 82. Symmetric eccentric cams 83 in the same shape are fixed and arranged at the same phase, outside of the left side plate 30L and the right side plate 30R at left and right edges of the shaft 81. Pressure levers 84 respectively engaged with the cams 83 are arranged outside of the side plates 30L and 30R.

Pressure springs (elastic members) 85 are arranged between the lower surfaces of the levers 84 and the upper surfaces of the pressure receiving units 45*b* of the flange members 45L and 45R on the left and right sides. A cam shaft drive unit 86 controlled by the control unit 309 is connected to the edge on the right side of the shaft through a transmission unit (not illustrated). For example, a stepping motor or a solenoid can be used for the cam shaft drive unit 86.

The drive unit 86 rotates the shaft 81 to set the rotating angle so that large raised sections of the left and right cams 83 face downward. In this way, the assembly is pressured (loaded) against the pressure roller 50, and the pressure state is held. More specifically, the left and right cams 83 press down the left and right levers 84, and the left and right springs 85 are compressed between the levers 84 and the upper surfaces of the pressure receiving units 45*b* of the members 45L and 45R. The compressive reaction force of the springs 85 presses down the left member 45L and the right member 45R together with the stay 42. The pad 43 is pressure contacted with the pressure roller 50 resisting the elasticity of the elastic layer 50*b* to interpose the belt 41 therebetween.

In this way, between the belt 41 and the pressure roller 50, the nip section N with a predetermined width in a recording paper conveyance direction a is formed. The pad 43 supports the formation of a pressure profile of the nip section N. The width of the nip section N in the present embodiment is about 9 mm at both end sections in the longitudinal direction and is about 8.5 mm at the center section, when the nip pressure is 600 N. This has an advantage that wrinkles of paper are unlikely to occur, because the conveyance speed at both end sections of the recording paper P is faster than that at the center section.

The shaft 81 is rotated to set the rotating angle so that the small raised sections of the left and right cams 83 face downward. In this way, pressuring of the assembly 40 is released (unweighted) from the pressure roller 50. Therefore, the compression of the left and right springs 85 is released. In this way, pressuring of the pad 43 against the pressure roller 50 is released.

The members 81 to 86 are included in the pressure releasing mechanism 80 of the assembly 40 relative to the pressure roller 50. The control unit 309 controls the mechanism 80 to the pressure state and maintains the state at least in the fixing operation of the apparatus 500. When the apparatus 500 is in a standby state, the control unit 309 controls the mechanism 80 to the pressure release state and maintains the state. This can prevent plastic deformation of the elastic layer 50*b* of the pressure roller 50 and the belt 41.

(2-4) Coil Unit 60

The unit 60 is a heat source (induction heating unit) that heats the belt 41 by electromagnetic induction, and the position is fixed relative to the left side plate 30L and the right side plate 30R on the upper surface side of the assembly 40, i.e. at a side substantially 180° opposite the pressure roller 50 of the assembly 40. The exciting coil (coil that generates magnetic flux) 62, a magnetic core 63, etc., are assembled on a long housing 61 along the belt 41 to form the unit 60.

The housing 61 is a horizontally-long, box-shaped, heat-resistant resin molding (mold member of electric insulating resin), wherein the left and right direction is the longitudinal direction. A bottom plate 61*a* of the housing 61 is the surface opposite the belt 41. The bottom plate 61*a* is curved inward of the housing 61 substantially along a semicircle range of the outer peripheral surface of the belt 41 at the cross section. In the housing 61, the side opposite the bottom plate 61*a* is open as an opening. In the housing 61, the bottom plate 61*a* faces the upper surface of the belt 41 at a predetermined gap (space) α, and the left and right edges are fixed to the left side plate 30L and the right side plate 30R by brackets 66.

Figure 7:
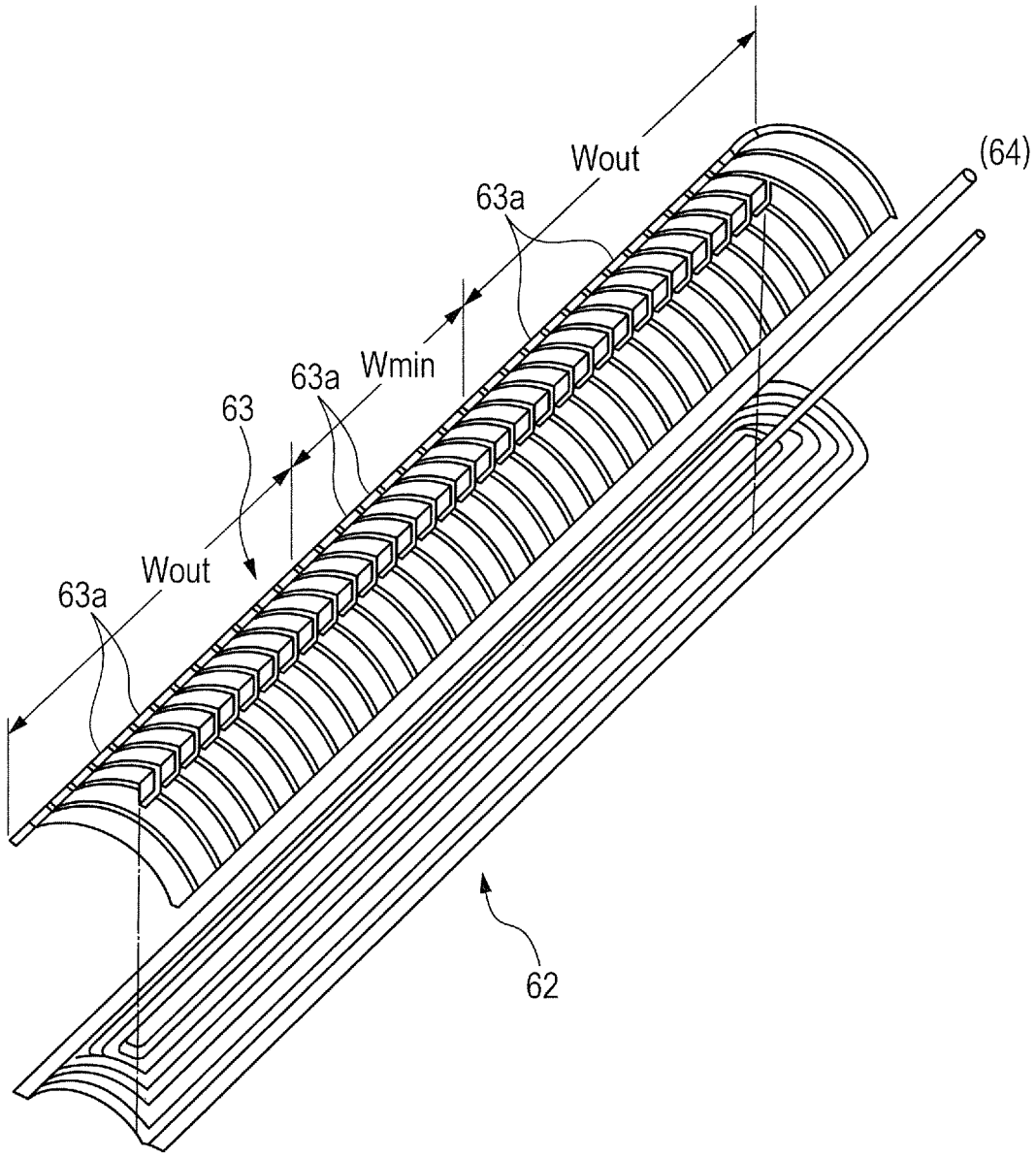
FIG. 7 is an exploded perspective view of a coil and a core of the coil unit.

The coil 62 includes, for example, a litz wire as an electric wire. As illustrated in FIG. 7, the coil 62 is wound to face part of the peripheral surface and the side surface of the belt 41 so as to form a shape of horizontally long ship bottom. The coil 62 is attached to the inner surface of the bottom plate 61*a* curved inward of the housing and is accommodated in the housing. A power supply apparatus (exciting circuit) 64 controlled by the control unit 309 applies a high-frequency current of 20 to 50 kHz to the coil 62.

The magnetic core 63 (hereinafter, simply "core") is an outer magnetic core that covers the coil 62 to prevent the magnetic field generated by the coil 62 from being substantially leaked to places other than a metallic layer (conductive layer) of the belt 41. The core 63 is arranged in the longitudinal direction of the belt 41. The core 63 is divided into a plurality of sections in the direction orthogonal to the recording paper conveyance direction a so as to be arranged side by side. The core 63 surrounds the center section of the winding and the periphery of the coil 62.

More specifically, when the direction orthogonal to the recording paper conveyance direction a is the longitudinal direction, the core 63 is arranged along the longitudinal direction of the belt 41. The core 63 is divided into a plurality of sections in the longitudinal direction as illustrated in FIG. 7 to be able to prevent an increase in the temperature of the paper non-passing section when papers having various recording paper sizes, such as small-sized recording paper like a postcard, A5, B4, A4, A3 and a size larger than A3, are respectively passed. The core 63 includes divided movable cores 63*a* that are individually and independently movable in a direction for changing the distance from the belt 41.

Further included is a core movement unit (retraction mechanism) 65 that moves at least one of the plurality of cores 63*a* to a first distance position D (FIG. 4) adjacent to the belt 41 and to a second distance position E (FIG. 5) that is farther from the belt 41 than the position D. The control unit (controller) 309 controls the operation of the core movement unit (retraction mechanism) 65 according to the size in the width direction of the recording paper. In the embodiment, the first distance position D is the home position of the cores 63*a*.

In the present embodiment, the width dimension in the direction crossing the recording paper conveyance direction a of cores 63*a* (including the dimension of the space from the adjacent core) is 10 mm. In the apparatus 500 of the present embodiment, the cores 63*a* corresponding to a minimum width area Wmin corresponding to the width of the recording paper in a minimum width size that can be passed through the apparatus 500 are located at the first distance position D as cores that do not need to be moved, and are fixed to the housing 61. The core movement unit 65 individually controls and moves the cores 63*a* in an area Wout other than the width area Wmin, to and from the first distance position D and the second distance position E.

The cores 63*a* efficiently deliver the AC magnetic flux generated by the coil 62 to the belt 41. More specifically, the cores 63*a* are used to improve the efficiency of the magnetic circuit (magnetic path) and to shield the magnetism. A material with low high permeability residual magnetic flux density, such as ferrite, can be used as a material of the cores 63*a*.

The cores 63*a* in an area corresponding to the paper non-passing section when recording paper in a width size smaller than the recording paper in the maximum width size that can be used for the apparatus is passed are controlled to move from the first distance position D to the second distance position E. This reduces the magnetic flux density relative to the section corresponding to the paper non-passing section of the belt 41, and the increase in the temperature of the paper non-passing section is reduced.

(2-5) Magnetic Flux Shielding Plates 10L and 10R and Shift Mechanism 20 Thereof The magnetic flux shielding plates 10L and 10R are members for reducing the magnetic flux acting on the belt 41 from the coil 62 in an area with a magnetic field between the coil 62 of the assembly 60 and the belt 41. More specifically, the magnetic flux shielding plates 10L and 10R are magnetic flux adjustment units that are moved to an adjustment position for reducing the magnetic flux acting on the paper non-passing area of the belt 41 when recording paper with a width smaller than the width in the maximum size that can be passed is passed to thereby adjust the magnetic flux, in the width direction orthogonal to the conveyance direction of the recording paper.

Through the shift mechanism 20 as a movement mechanism, the control unit (controller) 309 controls the magnetic flux shielding plates 10L and 10R according to the size in the width direction of the recording paper. More specifically, the plates 10L and 10R are moved to a retraction position (home position), which is a position in an area without a magnetic field, and to an effective position, which is for reducing the temperature of the paper non-passing section when small-sized recording paper with a width smaller than the width of large-sized recording paper with the maximum width that can be passed through the apparatus 500 is passed.

The magnetic flux shielding plates 10L and 10R may be made of non-magnetic metals, such as aluminum, copper, silver, gold and brass, or an alloy of the metals, or may be made of a material, such as ferrite and permalloy, that is a highly permeable member. The arrangement position of the plates 10L and 10R can be between the coil 62 and the cores 63*a*, between the coil 62 and the belt 41 or between the belt 41 and the core 44.

Figure 8:
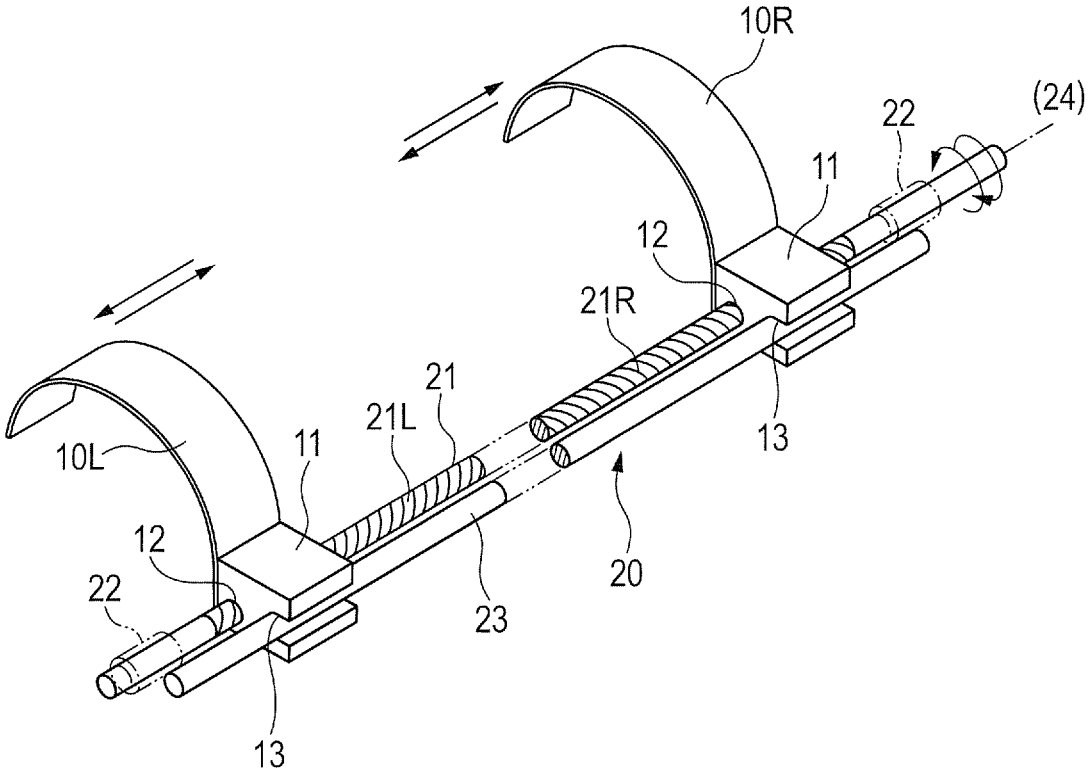
FIG. 8 is a perspective view of left and right magnetic shielding plates and a shift mechanism of the plates, in which a middle section is omitted.

In the apparatus 500 of the present embodiment, a pair of the plates 10L and 10R is arranged on both left and right end sections of the belt 41 in a space α formed between the assembly 40 and the belt 41. FIG. 8 is an external perspective view of the pair of left magnetic flux shielding plate 10L, the right magnetic flux shielding plate 10R and the shift mechanism 20, wherein the middle section is omitted.

In the present embodiments, the pair of left plate 10L and the right plate 10R is members obtained by bending band-shaped copper plates to a substantially semicircular shape along a substantially semicircular range on the outer peripheral surface of the belt 41. Base sections (carriages) 11 of the plates 10L and 10R respectively include screw hole 12 and guided concave section 13. A screw axis 21 is rotatably arranged between the left side plate 30L and the right side plate 30R of the apparatus chassis 30 through the bearings 22 and 22. The axis 21 includes a screw section 21L on the left half side and a screw section 21R on the right half side that are opposite screws. A guide axis 23 is arranged in parallel to the axis 21 between the left side plate 30L and the right side plate 30R.

In the left plate 10L, the screw section 21L on the left half side of the axis 21 is screwed with the screw hole 12 of the base section 11, and a concave section 13 is engaged with the axis 23. In this way, the left plate 10L is arranged on the left side of the belt 41 in the space α between the assembly 40 and the belt 41. In the right plate 10R, the screw section 21R on the right half side of the axis 21 is screwed with the screw hole 12 of the base section 11, and a concave section 13 is engaged with the guide axis 23. In this way, the right plate 10R is arranged on the right side of the belt 41 in the space α between the assembly 40 and the belt 41.

A screw axis drive unit 24 controlled by the control unit 309 is connected to the edge on the right side of the axis 21 through a transmission unit (not illustrated). The drive unit 24 is, for example, a stepping motor. A predetermined position on the left edge side of the belt 41 and a predetermined position on the right edge side of the belt 41 are the home positions, which are retraction positions, of the left plate 10L and the right plate 10R, respectively.

When the drive unit 24 positively and rotationally drives the axis 21 while the left plate 10L and the right plate 10R are located at the home positions, the left plate 10L and the right plate 10R respectively move by the same amount toward the center section of the belt 41, and the interval between the left plate 10L and the right plate 10R is narrowed down relative to the center. The control of the amount of positive rotation of the axis 21 moves the plates 10L and 10R to effective positions for reducing the temperature of the paper non-passing section when the small-sized recording paper with a width smaller than the width of the large-sized recording paper with the maximum width that can be passed through the apparatus 500 is passed. The left plate 10L and the right plate 10R are moved without touching the belt 41 and the bottom plate 61*a* of the housing 61 in the space α.

When the drive unit 24 reversely and rotationally drives the axis 21 while the interval between the left plate 10L and the right plate 10R is narrowed down, the left plate 10L and the right plate 10R respectively move by the same amount toward the home positions on both left and right end sections side of the belt 41. Therefore, the interval between the left plate 10L and the right plate 10R is increased relative to the center. The left plate 10L and the right plate 10R are moved without touching the belt 41 and the bottom plate 61*a* of the housing 61 in the space α.

The members 21 to 24 are included in the shift mechanism 20 as a magnetic flux shielding member movement unit that moves the plates 10L and 10R to the retraction positions and the effective positions. The insertion of the plates 10L and 10R is highly effective in weakening the magnetic flux by the movement of the cores 63*a* and reducing the amount of generated heat of the belt 41. The insertion of the plates 10L and 10R is also effective in controlling the heat generation distribution in the longitudinal direction more finely than the divided widths of the cores 63*a* by moving the plates 10L and 10R in conjunction with the movement mechanism 65 of the cores 63*a*. An example of the thickness of the plates 10L and 10R is 0.5 mm which is greater than a skin depth.

The plates 10L and 10R are arranged at both end sections of the belt 41 in the longitudinal direction. The longitudinal width (width in the direction crossing the recording paper conveyance direction) of the plates 10L and 10R arranged at both edges can be a width long enough to attain the magnetic flux shielding effect. The width can be a width that does not reduce the maximum heat generation width corresponding to the record paper in the maximum size. The width can be a width that can be arranged without enlarging the longitudinal width of the apparatus 500. Specifically, the width is 20 mm in the present embodiment.

(2-6) Heat Equalizing Roller 70 and Shift Mechanism 90 Thereof

The fixing apparatus 500 of the present embodiment includes the heat equalizing roller 70 as a heat equalizing member (heat absorption rotary member) that can be attached to and detached from (contacted with and separated from) the pressure roller 50. The heat equalizing roller 70 absorbs heat through the pressure roller 50 to prevent an excessive increase in the temperature of the paper non-passing area of the belt 41 when the small-sized recording paper is passed. The heat equalizing roller 70 disperses the heat of the pressure roller 50 in the axial direction of the pressure roller 50 to suppress the excessive increase in the temperature of the belt 41.

The heat equalizing roller 70 is a highly thermal conductive roller, and the thermal conductivity is equal to or greater than 100 W/m·K at 100 to 250° C. The heat equalizing roller 70 can be made of a material with the heat capacity equal to or smaller than 3.0 kJ/$m^3$·K at 100 to 250° C. The material can be aluminum, copper, etc. The diameter of an axis 70*a* of the heat equalizing roller 70 is mm, and the diameter of a roller main body (metallic cored bar) 70*b* is ϕ20 mm. The heat equalizing roller 70 has a solid configuration filled with the material. A PFA coat layer of 12 μm as a toner releasing resin layer 70*c* of the surface layer is arranged on the heat equalizing roller 70.

In the present embodiment, the heat equalizing roller 70 is arranged between the left side plate 30L and the right side plate 30R and below the pressure roller 50. The shift mechanism 90 is an abutment and separation unit for abutting the heat equalizing roller 70 with the pressure roller 50 and separating the heat equalizing roller 70 from the pressure roller 50.

In the present embodiment, the shift mechanism 90 picks up and moves the heat equalizing roller 70 relative to the pressure roller 50. In this way, the heat equalizing roller 70 is maintained to a state of being moved to a first position F (position of FIG. 4 illustrated by a solid line), which is a predetermined state of being abutted to the pressure roller 50. The shift mechanism 90 lifts down and moves the heat equalizing roller 70 in a predetermined way. In this way, the heat equalizing roller 70 is moved and held at a second position G (position of FIG. 4 illustrated by a chain line), which is a state of being separated from the pressure roller 50.

More specifically, below the pressure roller 50 and with the direction of axis substantially parallel to the longitudinal direction of the pressure roller 50, the heat equalizing roller 70 is rotatably arranged through the bearings 71 between the left side plate 30L and the right side plate 30R. The left and right bearings 71 are engaged with and arranged on vertical guide slit units (not illustrated) respectively arranged on the left side plate 30L and the right side plate 30R. Therefore, the heat equalizing roller 70 has a degree of freedom that allows movement in the up and down direction along the vertical guide slit units between the left side plate 30L and the right side plate 30R.

A cam shaft 91 is rotatably arranged on the left side plate 30L and the right side plate 30R through bearings 92 and 92. Symmetric eccentric cams 93 in the same shape are respectively fixed and arranged in the same phase on left and right edges of the shaft 91, outside of the side plates 30L and 30R. Pressure levers 94 engaged with the cams 93 are arranged outside of the side plates 30L and 30R.

Pressure springs (elastic members) 95 are arranged between the upper surfaces of the levers 94 and the lower surfaces of the bearings 92 and 92 on each side. A cam shaft drive unit 96 controlled by the control unit 309 is connected to the edge on the right side of the shaft through a transmission unit (not illustrated). For example, a stepping motor or a solenoid can be used for the drive unit 96.

The drive unit 96 rotates the shaft 91 to set the rotating angle so that the large raised sections of the left and right cams 93 face upward. In this way, the heat equalizing roller 70 is elastically in contact with the pressure roller 50 to be pressured (loaded) against the pressure roller 50, and the pressure state is maintained. More specifically, the left and right cams 93 press up the left and right levers 94, respectively, and the left and right springs 95 are compressed between the levers 94 and the lower surfaces of the bearings 92 and 92. The compressive reaction force of the springs 95 press up the heat equalizing roller 70 together with the left and right bearings 92 and 92, and the heat equalizing roller 70 is elastically pressure contacted against the pressure roller 50.

The shaft 91 is rotated to set the rotating angle so that the small raised sections of the left and right cams 93 face upward. In this way, the pressure of the heat equalizing roller 70 is released (unweighted) from the pressure roller 50. Therefore, the compression of the left and right springs 95 is released. As a result, the heat equalizing roller 70 is lowered and moved by its own weight, and the heat equalizing roller 70 is separated from the pressure roller 50 and maintained in the state.

The pressuring of the heat equalizing roller 70 and the pressure roller 50 causes the heat equalizing roller 70 to be pressed up by compressive reaction force of the springs 95. In this way, the heat equalizing roller 70 and the pressure roller 50 are compressed, and a contact nip section with a predetermined width is formed between the heat equalizing roller 70 and the pressure roller 50. The members 91 to 96 are included in the shift mechanism 90 as an abutment and separation unit that contacts the heat equalizing roller 70 with the pressure roller 50 and separates the heat equalizing roller 70 from the pressure roller 50.

(2-7) Fixation Operation

When the image forming apparatus is in a standby state, in the fixing apparatus 500, the fixing motor 53 is off and the rotation of the pressure roller 50 is stopped. The mechanism 80 is in a pressure release state, and the pressure of the nip section N is released. The power feeding to the coil 62 of the unit 60 is off. The plates 10L and 10R are located at the home positions that are the retraction positions. The heat equalizing roller 70 is moved downward and held at the second position G separated from the pressure roller 50.

The control unit (controller) 309 sets a pressure state to the mechanism 80 at predetermined control timing based on input of a print job start signal (image formation job start signal). As a result, a pressure state is set to the nip section N. When the motor 53 is turned on, the pressure roller 50 is rotationally driven in a counterclockwise direction as illustrated by an arrow in FIG. 4, at a predetermined speed.

As a result of the rotation of the pressure roller 50, rotational force is acted on the belt 41 by frictional force between the surface of the pressure roller 50 and the surface of the belt 41 at the nip section N. While the inner surface of the belt 41 is in close contact with the lower surface of the pad 43 to slide, the belt 41 follows and rotates around the periphery of the stay 42, the pad 43 and the core 44, at the same speed as the rotation speed of the pressure roller 50, clockwise as illustrated by an arrow. The flange units 45*a* of the left flange member 45L and the right flange member 45R restrict the movement in the thrust direction associated with the rotation of the belt 41.

At least in the image formation, the motor 53 controlled by the control unit 309 rotationally drives the pressure roller 50, and thus the belt 41 follows and rotates. The rotation is at substantially the same peripheral speed as the conveyance speed of the recording paper P that is conveyed from the secondary transfer unit T2 side and that carries unfixed toner images t. In the present embodiment, the surface rotation speed of the belt 41 is 300 mm/sec in the rotation, which allows fixing 80 A4-sized full-color images in one minute and 58 A4R-sized full-color images in one minute.

The control unit 309 supplies an alternating current (high-frequency current) of, for example, 20 kHz to 500 kHz to the coil 62 from the power supply apparatus 64. The coil 62 generates an alternating flux (magnetic field) by supply of the alternating current. The alternating flux is delivered to a metallic layer 1*a* of the belt 41 on the upper surface side of the belt 41 rotated by the core 63. Consequently, an eddy current is generated on the metallic layer 1*a*. The metallic layer 1*a* is self-heated (electromagnetic induction heat generation) by Joule heat generated from the eddy current, and the temperature of the belt 41 increases.

More specifically, when an area with the magnetic field generated from the unit 60 is passed, the metallic layer 1*a* generates heat by electromagnetic induction. The whole circumference of the rotating belt 41 is heated, and the temperature rises. In the present embodiment, the belt 41 and the coil 62 of the unit 60 maintains an electrically insulating state by a housing bottom plate (mold) 61*a* with a thickness of 0.5 mm. The interval between the belt 41 and the coil 62 is constant at 1.5 mm (distance (space $\alpha$) between the surface of the bottom plate 61*a* and the surface of the belt is 1.0 mm), and the belt 41 is uniformly heated.

The temperature sensor TH detects the temperature of the belt 41. The sensor TH detects the temperature of a section that is a paper passing area of the belt 41, and the detected temperature information is fed back to the control unit 309. The control unit (temperature control unit) 309 controls the power supplied from the power supply apparatus 64 to the coil 62 to maintain the detected temperature (information related to the detected temperature) input from the sensor TH at a predetermined target temperature (fixing temperature: information corresponding to a predetermined temperature).

When the detected temperature of the belt 41 is increased to the predetermined temperature, the power distribution to the coil 62 is cut off. In the present embodiment, to maintain fixed 180° C. as a target temperature of the belt 41, the frequency of the high-frequency current is changed based on the detected value of the sensor TH, and the power input to the coil 62 is controlled to adjust the temperature.

When the pressure roller 50 is driven, and the temperature is controlled after the belt 41 has risen to the predetermined fixing temperature, a guide member 33 guides and delivers the recording paper P with the unfixed toner images t to the nip section N, wherein the toner image carrying surface of the recording paper P faces the belt 41. The recording paper P comes in close contact with the outer peripheral surface of the belt 41 at the nip section N, and the recording paper P is nipped and conveyed together with the belt 41 through the nip section N.

In this way, the heat of the belt 41 is mainly provided, and pressurizing forth of the nip section N is received to fix the unfixed toner images t on the surface of the recording paper P by thermal pressure. The recording paper P that has passed through the nip section N is self-separated (separated by curvature) from the outer peripheral surface of the belt 41 by the deformation of the surface of the belt 41 at the exit portion of the nip section N, and is conveyed outside of the fixing apparatus.

The unit 60 is arranged outside, not inside, of the belt 41 where the temperature rises. Therefore, the temperature of the coil 62 is unlikely to be high, and the electric resistance does not increase. As a result, a loss caused by Joule heat can be reduced even if a high-frequency current is applied. The arrangement of the coil 62 outside also contributes to a reduction in the diameter (reduction in the heat capacity) of the belt 41, and the energy saving performance is excellent.

The heat capacity is significantly low in the configuration. Therefore, as for the warming up time of the fixing apparatus 500 of the present embodiment, for example, if 1200 W is input to the coil 62, 180° C. as the target temperature can be attained in about 15 seconds. Heat operation during standby is not necessary, and the power consumption can be significantly reduced.

(2-8) Suppression of Increase in Temperature of Paper Non-Passing Section

In FIG. 2, Wmax denotes a width size (paper passing area) of large-sized recording paper with the maximum width that can be passed through the apparatus 500. In the present embodiment, the large-sized recording paper is a paper having 13 inch in width and 19 inch in length and the paper is vertically fed. Therefore, Wmax is 13 inches (330 mm).

In the present embodiment, the width (longitudinal dimension) of the belt 41 is 390 mm, the width of the pressure roller 50 is 370 mm, and the width of the equalizing roller 70 is 350 mm. The effective heating width of the coil unit 60 for heating the belt 41 is set to cover the maximum paper passing width Wmax (330 mm).

The width (390 mm) of the belt 41 is greater than the maximum paper passing width Wmax (330 mm). Therefore, extended width sections with a 30 mm width are included outside on the left and right of the maximum paper passing width area Wmax of the belt 41. The left and right extended width sections of the belt 41 are the home positions as the retraction positions of the left magnetic flux shielding plate 10L and the right magnetic flux shielding plate 10R (width 20 mm).

An area A is a paper passing area of small-sized recording paper with a width smaller than Wmax (width equal to or greater than the width area Wmin (FIG. 7) corresponding to the width of the recording paper with the minimum width size that can be passed through the apparatus 500). In the apparatus of the present embodiment, the recording paper P is passed and conveyed based on the center. A center reference line Q is a virtual line. Areas B are paper non-passing areas in the belt 41 and the pressure roller 50 formed when the small-sized recording paper is passed. The area B is a difference area ((Wmax−A)/2) between the paper passing area Wmax of the large-sized recording paper and the paper passing area A of the passed small-sized recording paper, and the areas B are generated on both sides of the paper passing area A.

When the small-sized recording paper is continuously passed, the paper non-passing areas B of the belt 41 generate heat by a predetermined amount of generated heat per unit length as in the section corresponding to the paper passing area A, and the heat is accumulated, although the thermal energy is not consumed to heat the recording paper P. Therefore, a so-called paper non-passing section temperature increase phenomenon occurs, in which the temperature of the sections of the belt 41 corresponding to the paper non-passing areas B rises above the temperature of the section corresponding to the paper passing area A. As a result of the increase in the temperature of the paper non-passing sections of the belt 41, the temperature of the sections corresponding to the paper non-passing sections also rises above the section corresponding to the paper passing section in the pressure roller 50 abutting to the belt 41.

If the thickness of the heating member 41 is reduced to reduce the heat capacity in order to quickly increase the temperature of the heating member 41, the cross-sectional area of the cross section perpendicular to the axis of the heating member 41 is significantly reduced. Therefore, the thermal conduction to the axial direction is not excellent. The tendency is more prominent if the thickness is smaller. The thermal conduction is further reduced in a material such a resin with low thermal conductivity. This is apparent from the Fourier's law that expresses a quantity of heat Q transmitted per unit time by $Q=\lambda\cdot f(\theta 1-\theta 2)/L$, wherein $\lambda$ denotes thermal conductivity, $\theta 1-\theta 2$ denotes a temperature difference between two points, and L denotes a length.

There is no problem when recording paper with a full length in the longitudinal direction of the heating member 41, i.e. recording paper with the maximum paper passing width (large-sized recording paper), is passed and fixed. However, when small-sized recording paper with a width smaller than that is continuously passed, the temperature in the paper non-passing areas of the heating member 41 rises above the controlled temperature, and the temperature difference between the temperature in the paper passing area and the temperature in the paper non-passing areas becomes significantly large (increase in the temperature of the paper non-passing sections).

Due to the increase in the temperature of the paper non-passing sections of the heating member 41, the heat-resistance lifetime of a peripheral member made of a resin material may be reduced, or a thermal damage may occur. Furthermore, when recording paper in a larger width size is passed just after small-sized recording paper is continuously passed, wrinkles of paper or fixing unevenness may occur due to partial temperature unevenness.

The greater the heat capacity of the conveyed recording paper and the higher the throughput (the number of printed pages per unit time), the larger the temperature difference between the paper passing area and the paper non-passing areas. Therefore, an application to a copying machine with a high throughput is difficult when the heating apparatus includes thin heating members with low heat capacity.

In the present embodiment, the increase in the temperature of the paper non-passing sections when the small-sized recording paper is passed is appropriately suppressed by the following three controls of a), b) and c).

a) Suppression of Increase in Temperature of Paper Non-Passing Sections by Control of Movement of Divided Movable Cores 63*a*

The core 63 of the unit 60 is arranged in the longitudinal direction of the belt 41. The core 63 is divided into a plurality of cores in the longitudinal direction to be able to prevent the increase in the temperature of the paper non-passing sections of small-sized recording paper with various width sizes, and the core 63 includes the divided movable cores 63*a* that can individually and independently move in a direction for changing the distance from the belt 41. The unit 60 includes the core movement mechanism 65 that is controlled by the control unit 309 and that moves the individual cores 63*a*.

When the recording paper P passed through the apparatus is small-sized recording paper, the control unit 309 places the cores 63*a* of the plurality of divided movable cores 63*a*, corresponding to the paper passing area A of the small-sized recording paper to be passed, at the first distance position D. The control unit 309 controls the core movement mechanism 65 to place the other cores 63*a* at the second distance position E.

Figure 5:
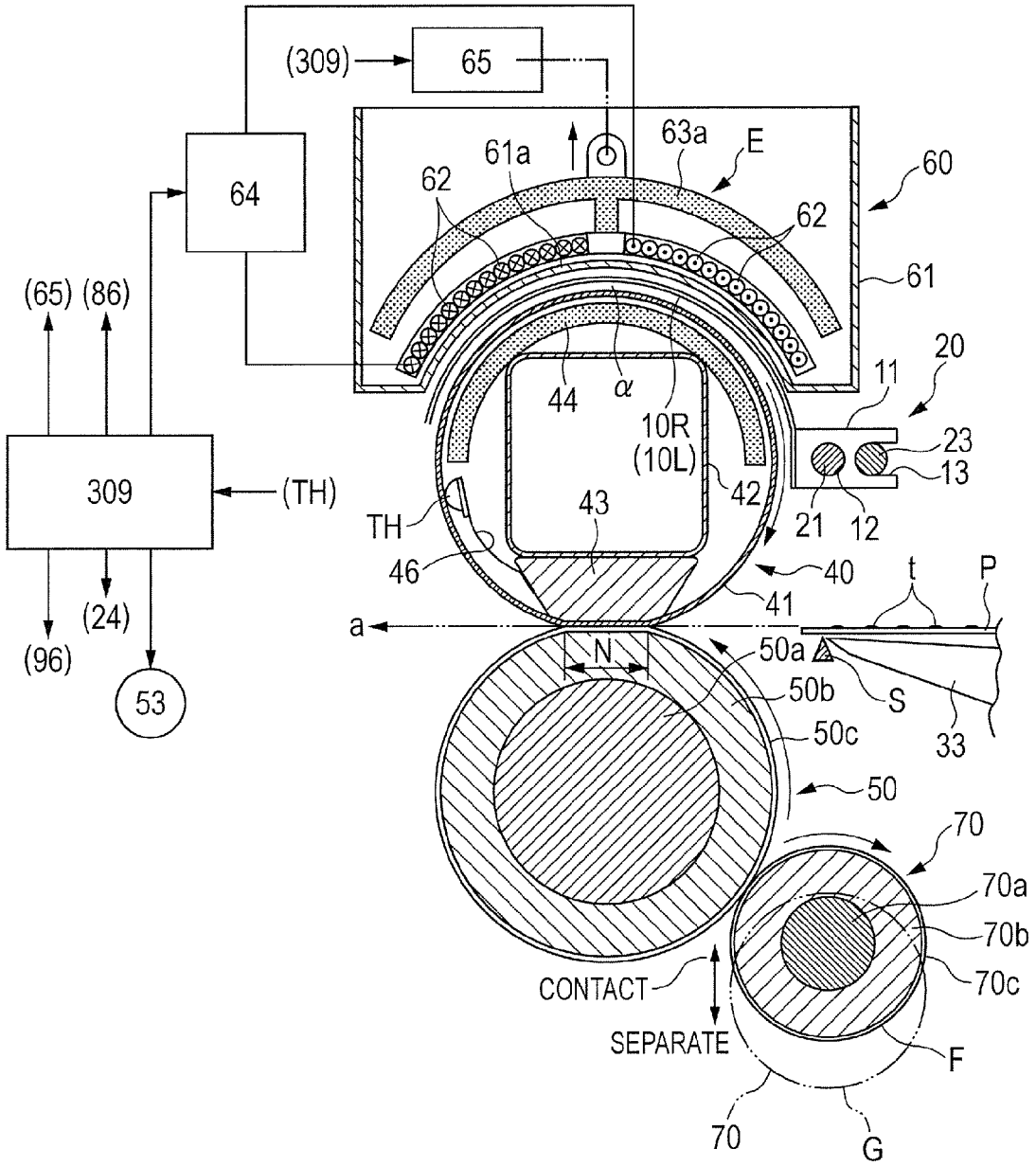
FIG. 5 illustrates a state in which a divided movable core of a coil unit is moved to a second distance position.

In the present embodiment, the mechanism 65 can move the individual cores 63*a* to the first distance position D close to the coil 41 with an interval of 0.5 mm as illustrated in FIG. 4 and to the second distance position E separated from the coil 41 with an interval of 10 mm as illustrated in FIG. 5. When the cores 63*a* are at the first distance position D, the heat generation efficiency of the section of the belt 41 corresponding to the cores is significantly high. On the other hand, when the cores 63*a* are at the second distance position E, the heat generation efficiency of the section of the belt 41 corresponding to the cores is reduced.

When a print job (recording paper passing job) is started, the control unit 309 reads a size input value of the recording paper to be passed. If the recording paper to be passed is the large-sized recording paper, the control unit 309 controls the mechanism 65 to place all the cores 63*a* at the first distance position D. If the recording paper to be passed is small-sized recording paper, the control unit 309 controls the mechanism 65 to place the cores 63*a* corresponding to the paper passing area A of the small-sized recording paper to be passed at the first distance position D and to place the other cores 63*a* at the second distance position E.

In this way, the heat generation efficiency of the sections corresponding to the paper non-passing areas B of the belt 41 becomes lower than that of the section corresponding to the paper passing section A, and the increase in the temperature of the paper non-passing sections of the belt 41 and the pressure roller 50 is suppressed.

b) Suppression of Increase in Temperature of Paper Non-Passing Sections by Control of Movement of Magnetic Flux Shielding Plates 10L and 10R When a print job is started, the control unit 309 reads the size input value of the recording paper to be passed. If the recording paper to be passed is the large-sized recording paper, the plates 10L and 10R are held at the home positions as the retraction positions. If the recording paper is small-sized recording paper, the drive unit 25 positively and rotationally drives the axis 22 to move the respective plates 10L and 10R toward the center section of the belt 41. The drive unit 25 moves the plates 10L and 10R to positions where the interval between the plates 10L and 10R becomes an interval substantially corresponding to the width of the small-sized paper, and the drive of the axis 22 is stopped.

The plates 10L and 10R are moved in conjunction with the movement mechanism 64 of the cores 63*a* to control the heat generation distribution in the longitudinal direction of the belt 41, more finely than the divided widths of the cores 63*a*. The increase in the temperature of the paper non-passing sections of the belt 41 and the pressure roller 50 is suppressed.

c) Suppression of Increase in Temperature of Paper Non-Passing Sections by Controlling Attachment and Detachment of Heat Equalizing Roller 70

When a print job is started, the control unit 309 reads size information in the width direction of the recording paper to be passed. If the recording paper to be passed is the recording paper with the maximum size, the control unit 309 controls the mechanism 90 to hold the heat equalizing roller 70 at the second position G separated from the pressure roller 50.

On the other hand, if the recording paper to be passed is small-sized recording paper, the control unit 309 controls the contact and separation mechanism 90 to move the heat equalizing roller 70 to the first position F abutting to the pressure roller 50 under a predetermined condition. The roller 72 abutting to the pressure roller 50 rotates, following the rotation of the pressure roller 50. Equalization of the temperature in the longitudinal direction of the pressure roller 50 is promoted, and the increase in the temperature of the paper non-passing sections of the belt 41 and the pressure roller 50 is suppressed.

Figure 9:
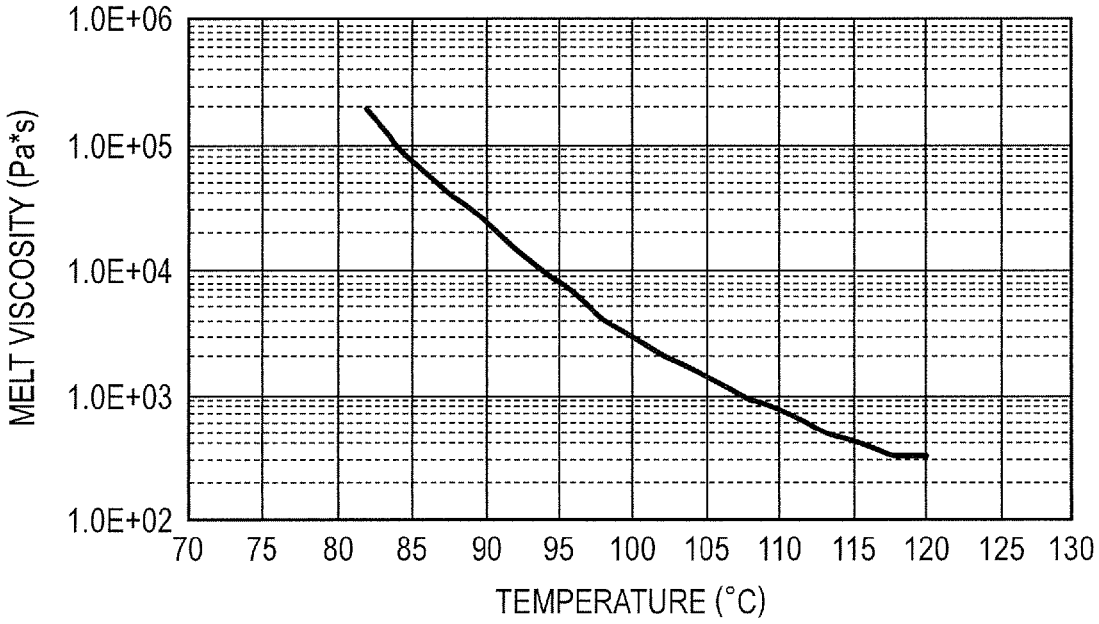
FIG. 9 illustrates melt viscosity of a toner used in the first embodiment.

FIG. 9 illustrates melt viscosity of a toner used in the present embodiment. The melt viscosity of the toner is measured by a flow tester. Flow tester CFT-500D (manufactured by Shimadzu Corporation) is used in the measurement of the melt viscosity of the toner by the flow tester, and the measurement is performed under the following conditions according to the operation manual of the apparatus.

Figure 10:
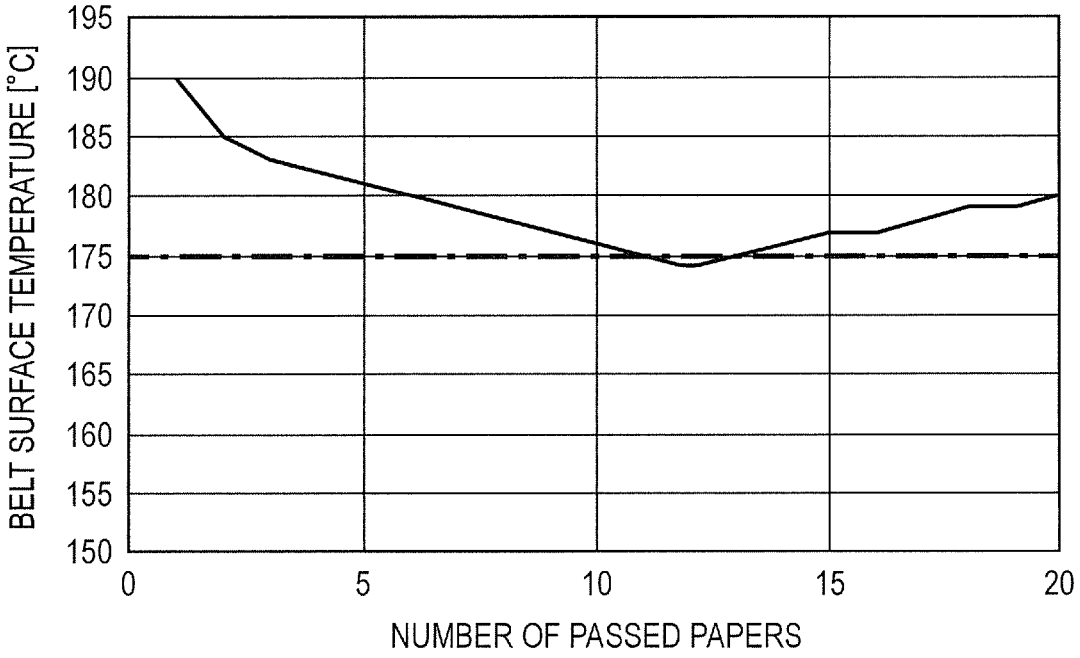
FIG. 10 is a graph of a lowest temperature relative to the number of passed papers in a conventional example.

Sample: 1.0 g of a toner is weighted, and a pressure molding device with a diameter of 1 cm pressures the toner for one minute at load 20 kN to mold the toner to form a sample Die hole diameter: 1.0 mm, die length: 1.0 mm, cylinder pressure: $9.807\times10^5$ (pa), measurement mode: temperature increase method, temperature increase speed: 4.0° C./min Based on the above method, the viscosity (Pa·s) of the toner at 50° C. to 200° C. is measured. FIG. 10 illustrates transition of the surface temperature of the belt 41 relative to the number of passed papers when small-sized recording paper, which is GF-C104 (manufactured by Canon Inc.): the recording paper P of A4 size, is continuously passed (horizontal feeding), in an environment of temperature 15° C. and humidity 15%. The heat equalizing roller 70 is always in contact with the pressure roller 50 from the beginning to the end. For the surface temperature of the belt 41, the infrared radiation thermometer IT 2-50 (manufactured by KEYENCE Corporation) is used to measure the temperature at the center section of the belt width.

The heat equalizing roller 70 is always attached to the pressure roller 50. Therefore, the heat of the pressure roller 50 is taken away by the heat equalizing roller 70, and the belt surface temperature also lowers. As a result, the temperature becomes below 175° C. which is a belt surface temperature at which the toner is peeled off from the recording paper, and the toner is peeled off from the recording paper.

Figure 11:
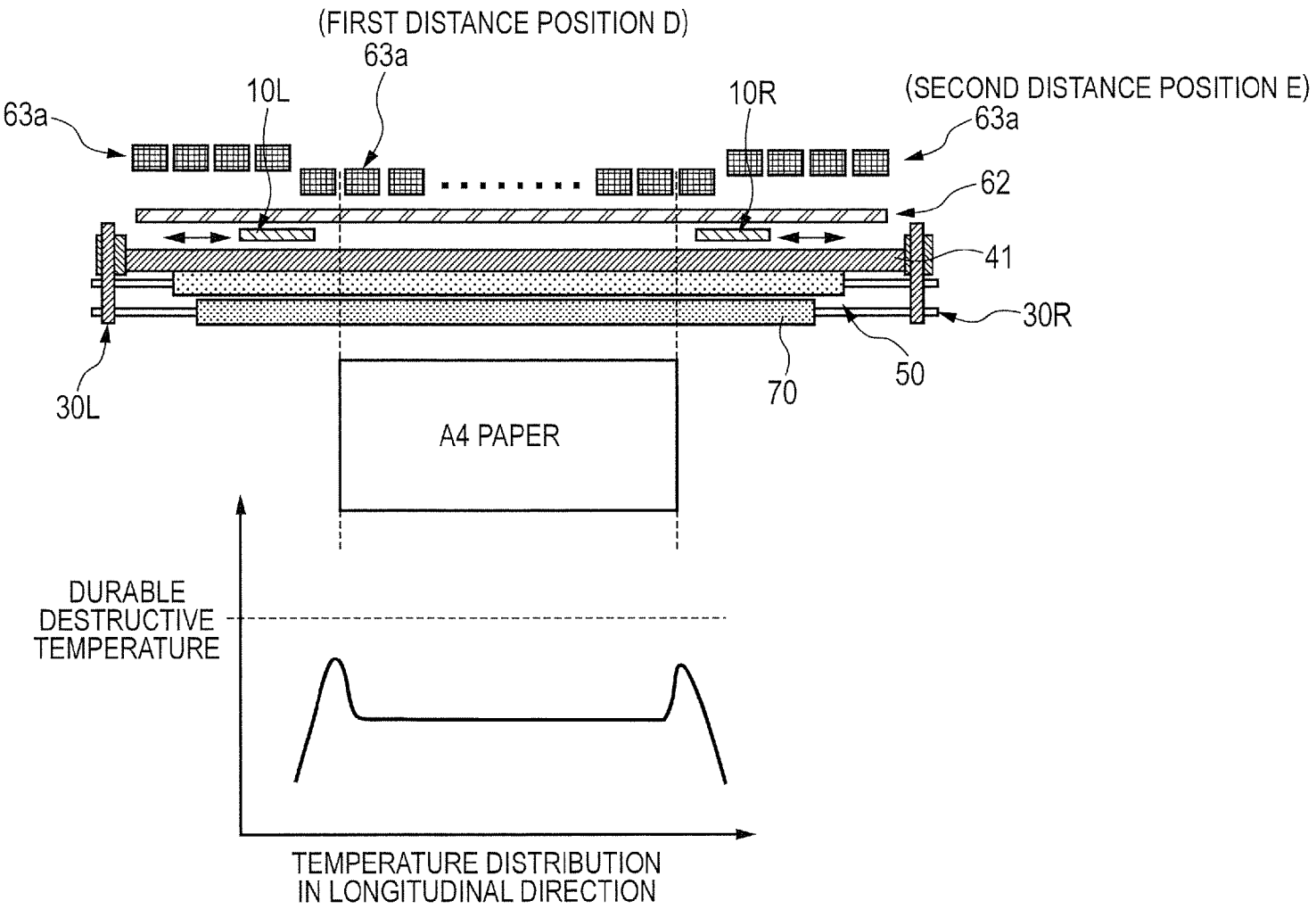
FIG. 11 illustrates core movement and a method of moving magnetic shielding plates and a heat equalizing roller.

In the fixing apparatus configuration when the paper is passed, the power applied to the coil 62 is set to 1200 w. The recording paper to be passed is A4 size, which is small-sized recording paper. Therefore, as illustrated in FIG. 11, four cores 63*a* of the unit 60 are moved to the second distance position E in each of the both end sections. The positions of the magnetic flux shielding plates 10L and 10R are set to positions 46 mm from the edges of the fixing belt (positions 16 mm outside from the edges of the recording paper). The heat equalizing roller 70 is always attached to the pressure roller 50.

FIG. 11 illustrates a temperature distribution in the longitudinal direction of the belt relative to the number of passed papers. The infrared thermography FSV-7000S (manufactured by Apiste Corporation) is used to measure the temperature distribution in the longitudinal direction of the belt. As illustrated in FIG. 11, the belt surface temperature of the paper non-passing sections does not exceed the durable destructive temperature, which is the temperature at which the belt is destructed, regardless of the number of passed papers.

In the present embodiment, the control of abutment of the heat equalizing roller 70 to the pressure roller 50, which is one of the measures for the increase in the temperature of the paper non-passing sections in the paper passing job of the small-sized recording paper, is performed after the temperature of the belt passes the lowest temperature which is the minimum temperature relative to the number of passed papers.

The positions of the divided cores 63*a* in the unit 60 in the initial state (state before the reception of the print job) of the fixing apparatus 500 of the present embodiment and the initial positions of the magnetic shielding plates 10L and 10R are positions corresponding to the A4 size. Specifically, four cores 63*a* are raised from the edges as illustrated in FIG. 11, and the positions of the magnetic shielding plates 10L and 10R are positions 35 mm from the edges of the fixing belt. The initial position of the heat equalizing roller 70 is detached from the pressure roller 50. The initial position of the pressure roller 50 is detached from the belt 41.

Figure 12:
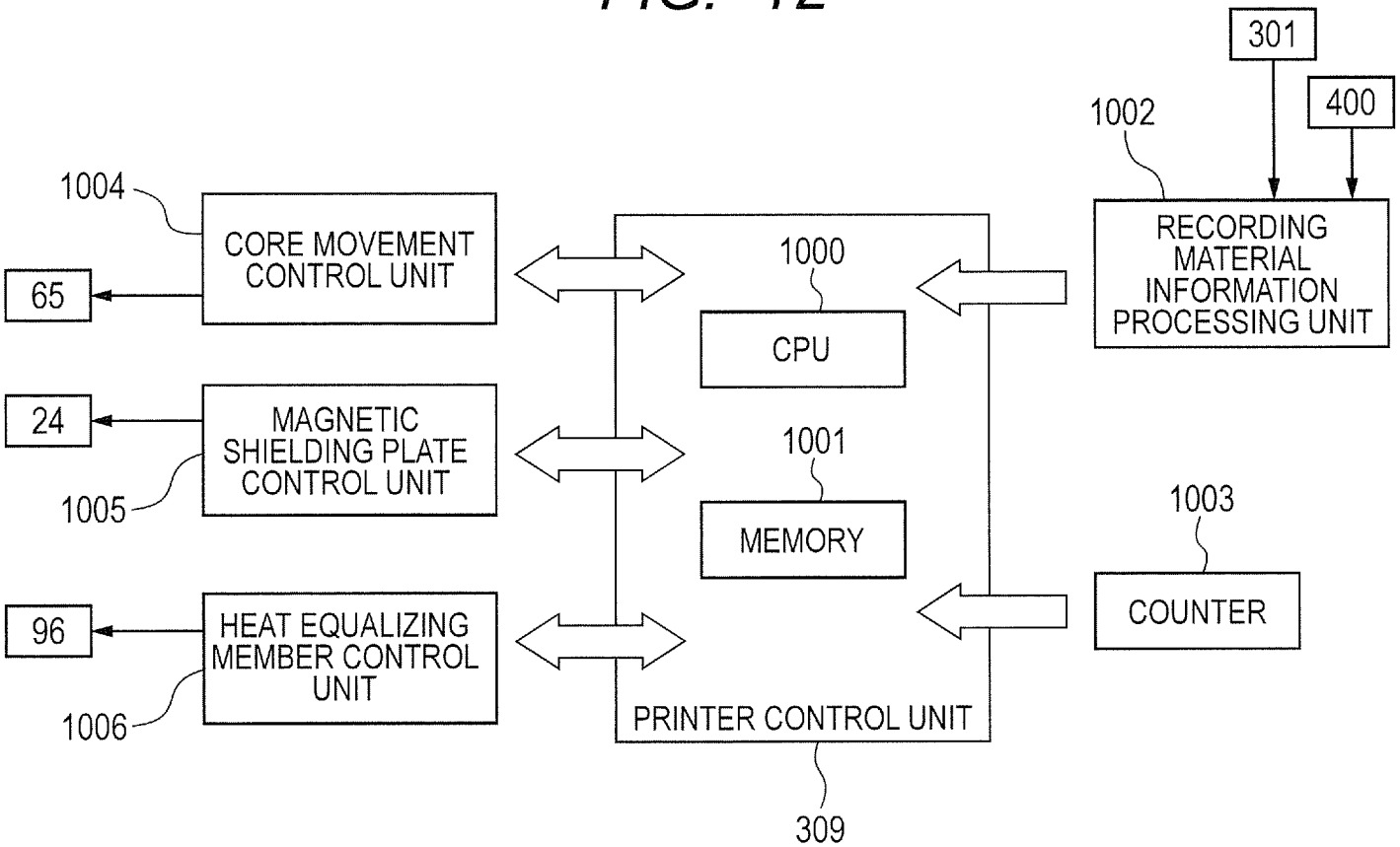
FIG. 12 is a block diagram for illustrating control of the first embodiment.

The control of the present embodiment will be described with reference to a block diagram illustrated in FIG. 12. An operation unit 301 or a PC (external host apparatus) 400 transmits information of the type of the recording paper output by the user (sheet size and sheet type) to a recording paper information processing unit 1002. The information of the recording paper information processing unit 1002 is transferred to a CPU 1000 of the printer control unit 309.

The CPU 1000 refers to a memory 1001 to determine movement controlled amounts of the cores 63*a* of the unit 60 and controlled amounts of the magnetic shielding plates 10L and 10R based on the information of the recording paper information processing unit 1002. The core movement controlled amounts and the magnetic shielding member controlled amounts are transferred to a core movement control unit 1004 and a magnetic shielding plate control unit 1005.

The core movement control unit 1004 and the magnetic shielding plate control unit 1005 control the drive units 65 and 24, respectively, to move the cores 63*a* and the magnetic shielding plates 10L and 10R to the predetermined positions. The belt inner temperature at the start of the job and information of a print page counter 1003 as a counting device are transferred to the CPU 1000. The CPU 1000 refers to the memory 1001 to determine contact timing of the heat equalizing roller 70 to the pressure roller 50 based on the information. If the CPU 1000 determines that it is contact timing of the heat equalizing roller 70 to the pressure roller 50, the CPU 1000 issues an instruction to a heat equalizing member control unit 1006 and drives the drive unit 96 to cause the heat equalizing roller 70 to come in contact with the pressure roller 50.

The counter 1003 is a count unit that counts the number of recording papers passing through the fixing apparatus 500 (count unit that counts the number of times of image formation).

Figure 13:
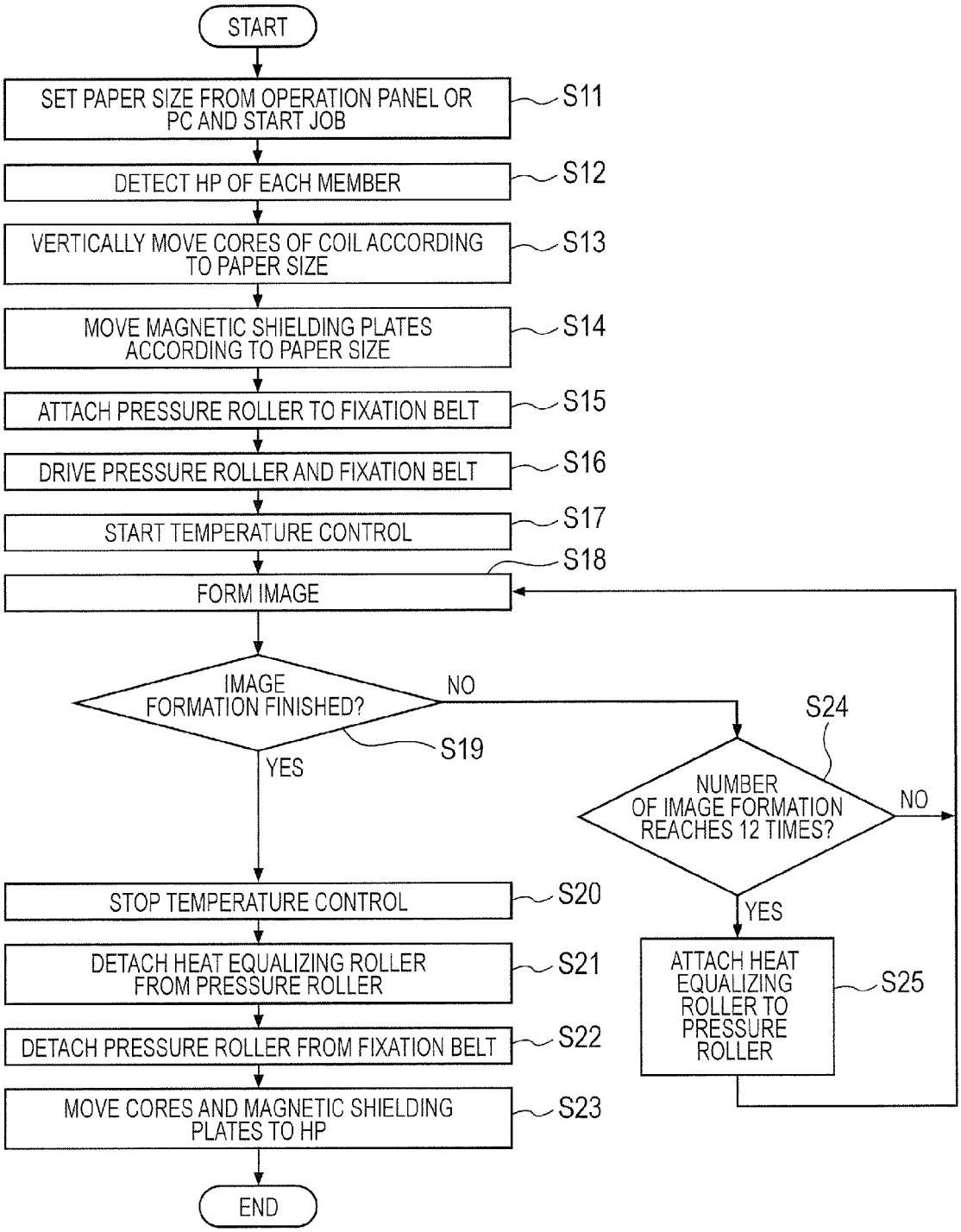
FIG. 13 is a flow chart for illustrating the control of the first embodiment.

FIG. 13 illustrates a control flow chart of the present embodiment. The type (size) of the recording paper P to be passed is set from an operation panel of the operation unit 301 or from the PC (external host apparatus) 400, and a job to be copied or printed is transmitted to the image forming apparatus to start the job (JOB) (S11). The home positions (HP) of the members (the cores 63*a* of the coil 62, the magnetic shielding plates 10L and 10R, the heat equalizing roller 70 and the pressure roller 50) (S12) are detected. The temperature of the inner surface of the belt at the start of the job is detected, and the following control is performed if the temperature is equal to or lower than a threshold (predetermined set temperature: 80° C. in the present embodiment).

The cores 63*a* of the coil 62 and the magnetic shielding plates 10L and 10R are then moved according to the paper size (S13 and S14). The pressure roller 50 is attached to the belt 41 and pressured to form the nip section N (S15). The pressure roller 50 is rotationally driven to rotate the belt 41 (S16). A current is applied to the coil 62 to cause the belt 41 to generate heat to control the temperature of the belt 41 (S17). The image formation stations Pa, Pb, Pc and Pd form images of the colors, transfer and fix the images to the recording paper, and output the images (S18).

If the image formation job is finished, the current flowing through the coil 62 is cut off, and the temperature control of the belt 41 is stopped (S19 and S20). The heat equalizing roller 70 is detached from the pressure roller 50 (S21). The pressure roller 50 is detached from the belt 41 (S22). The cores 63*a* of the unit 60 and the magnetic shielding plates 10L and 10R are moved to the initial positions (home positions), and the job is finished (S23).

If the image formation job is not finished, the CPU 1000 as a controller determines whether the number of image formation reaches twelve times (S24). If the number of image formation is less than twelve times, the image formation operation is continuously repeated. If the number of image formation is twelve times or more, the contact and separation mechanism 90 is activated to abut the heat equalizing roller 70 to the pressure roller 50 to suppress the increase in the temperature of the paper non-passing sections (S25). The image formation operation is subsequently performed until the job is finished.

In the present embodiment, the process is executed after passing the lowest temperature at which the temperature of the belt is the lowest relative to the number of passed papers, and the number of image formation is counted. However, the present invention is not limited to the configuration. The temperature of the belt may be detected to determine whether the temperature of the belt has passed the lowest point since the start of the execution of the job, and then the heat equalizing roller 70 may be abutted to the pressure roller 50.

If the temperature inside of the belt at the start of the job is higher than the predetermined temperature (80° C. in the present embodiment), the heat equalizing roller 70 is attached to the pressure roller 50 before the pressure roller 50 is driven. The subsequent control is the same as when the inner temperature is lower than the predetermined temperature (80° C.)

To summarize the foregoing, the present embodiment includes a period of separating, without abutting, the heat equalizing roller from the pressure roller even if images are formed on small-sized recording paper. Specifically, even in a job for continuously forming images (image heating process) on a plurality of small-sized recording papers, two sequences of a first mode for abutting the heat equalizing roller to the pressure roller 50 in the middle of the job and a second mode for abutting the heat equalizing roller 70 to the pressure roller from the beginning (during warm-up) can be performed.

The first mode will be specifically described. If the temperature detected by the temperature sensor TH of the fixing belt is lower than the predetermined temperature (80° C.) when a print command (command for executing the image heating process) is received, the heat equalizing roller 70 is separated from the pressure roller 50 after the reception of the print command, through the warm-up processing, until the images are formed on a predetermined number of recording papers. During this period, the increase in the temperature of the paper non-passing sections of the fixing belt is at a level that does not pose a problem. The temperature detected by the temperature sensor TH of the fixing belt when the print command is received may not necessarily be the temperature detected at the same time as the reception of the print command. Therefore, the temperature may be replaced by temperature detected by the temperature sensor TH of the fixing belt after several seconds from the reception of the print command.

The contact and separation mechanism abuts the heat equalizing roller 70 to the pressure roller 50 when the predetermined number of images is formed with progress of the job (when the temperature of the paper non-passing sections of the fixing belt rises to the upper limit temperature). As a result, the time required to warm up the fixing apparatus becomes as short as possible, and the degradation of the paper non-passing sections of the fixing belt by heat can be prevented while satisfying the quick start property.

The second mode will be specifically described. If the temperature detected by the temperature sensor TH of the fixing belt when the print command is received is equal to or higher than the predetermined temperature (80° C.), i.e. if the temperature of the fixing belt is high because not much time has passed after the previous job, the warm-up processing can be performed without a trouble (quick start is possible (fixing process is possible)). Therefore, the heat equalizing roller 70 is abutted to the pressure roller at the start of preparatory operation (warm-up) after the reception of the print command. This can alleviate a situation, in which the increase in the temperature of the paper non-passing sections of the fixing belt cannot be ignored as a result of the execution of the previous image formation job. In this case, the quick start property can be satisfied even if the heat equalizing roller 70 is abutted to the pressure roller 50.

The CPU 1000 as a controller controls the switch between the first mode and the second mode according to the detected temperature of the paper non-passing sections of the fixing belt detected by the temperature sensor TH.

Figure 14:
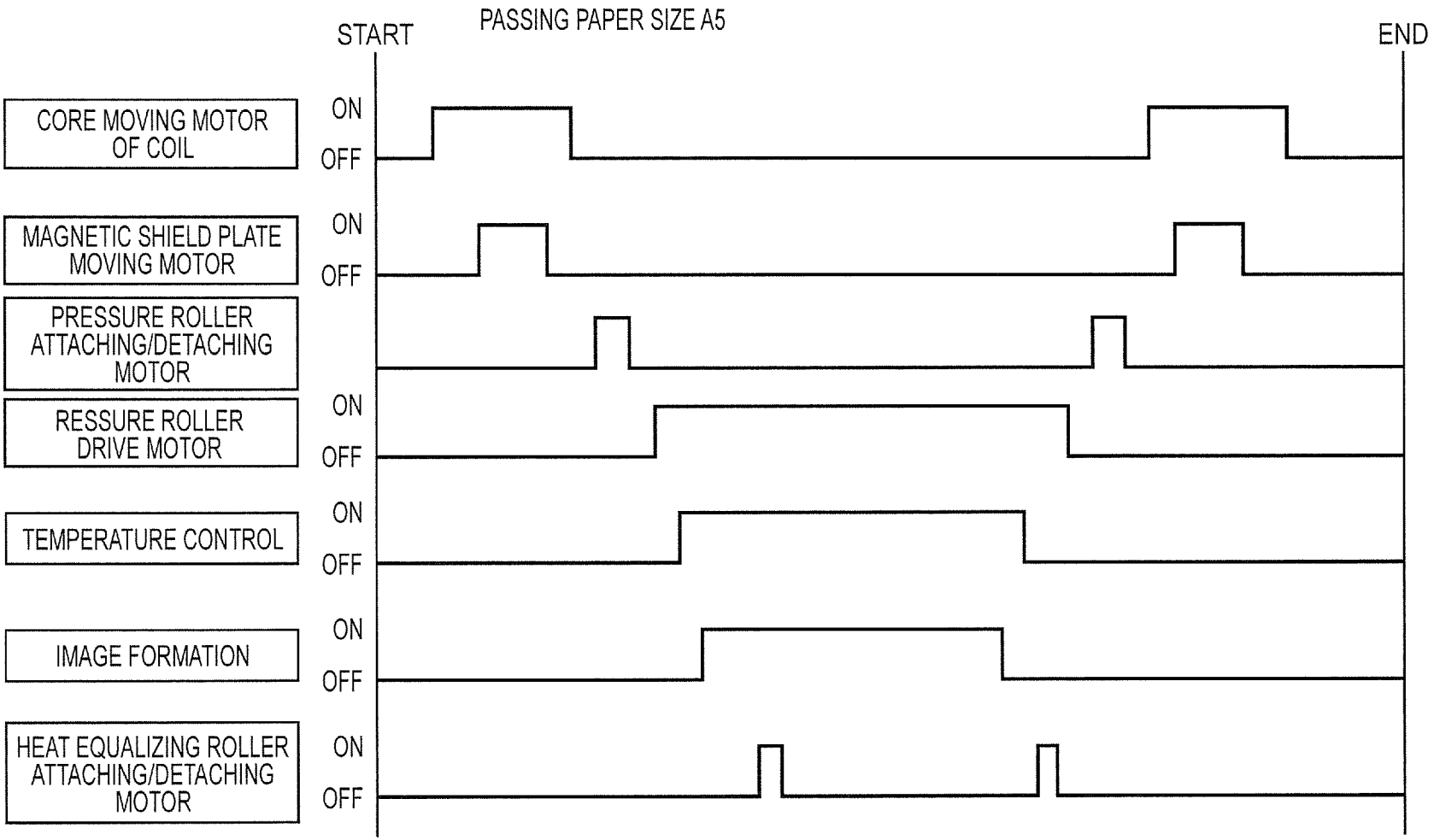
FIG. 14 is a timing chart diagram for illustrating the control of the first embodiment.

A timing chart is used to illustrate the control of the present embodiment in FIG. 14. FIG. 14 is a timing chart when recording paper of A5 size is output. In FIG. 14, the process is started when the temperature inside of the belt is equal to or lower than the threshold (80° C. in the present embodiment) after the reception of the image formation job by the image forming apparatus.

Since the passing paper size is A5, the core moving motor (mechanism 65) of the coil unit 60 is first activated to perform control of raising six cores 63*a* from both end sections. While the cores 63*a* are moved, the magnetic shield plate moving motor (mechanism 20) is activated to move the magnetic shielding plates 10L and 10R to the positions 80 mm from the edges of the belt. The pressure roller attaching/detaching motor (mechanism 80) is then driven to attach the pressure roller 50 to the belt 41 to form the nip section N.

Next, the drive motor 53 drives the pressure roller 50 to rotationally drive the pressure roller 50 and the belt 41. A voltage is applied to the coil 62 to control the temperature of the belt 41. The image formation is started, and images are output on the recording paper. When the number of passed papers reaches a predetermined number, the attachment/detachment motor (mechanism 90) of the heat equalizing roller 70 is driven to attach the heat equalizing roller 70 to the pressure roller 50 to suppress an abnormal increase in the temperature of the paper non-passing sections of the belt 41.

When the image formation is finished, the temperature control is stopped, and the heat equalizing roller attachment/detachment motor (mechanism 90) is driven to detach the heat equalizing roller 70 from the pressure roller 50. The pressure roller drive motor 53 is then stopped to stop the drive of the pressure roller 50. The pressure roller attaching/detaching motor (mechanism 80) is driven to detach the pressure roller 50 from the belt 41. The core moving motor (mechanism 65) of the unit 60 and the magnetic shielding plate motor (mechanism 20) are then driven to move the cores 63*a* and the magnetic shielding plates 10L and 10R to the home positions, and the job is finished.

Figure 15:
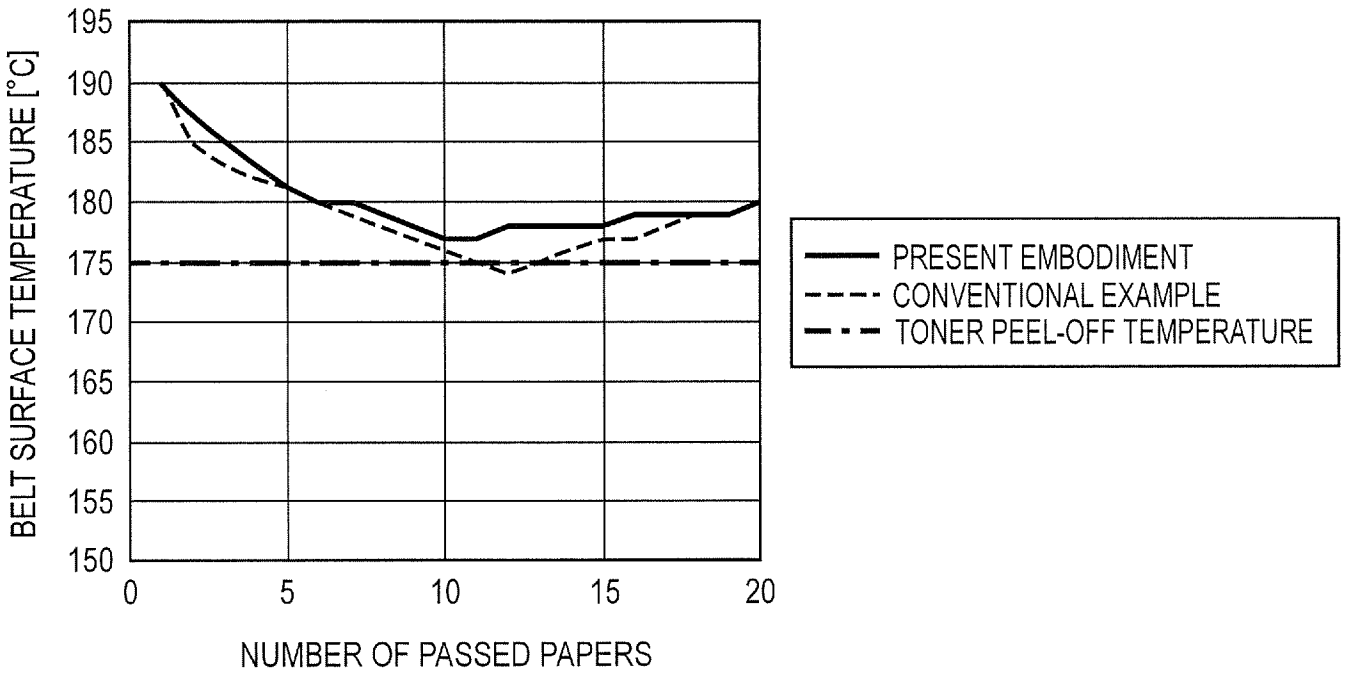
FIG. 15 is a graph of a lowest temperature relative to the number of passed papers for illustrating an effect of the first embodiment.

FIG. 15 illustrates transition of the belt surface temperature relative to the number of passed papers when GF-C 104 (manufactured by Canon Inc.): the recording paper of A4 size is continuously passed in the fixing apparatus of the present embodiment under an environment of temperature 15° C. and humidity 15%. For the belt surface temperature, the infrared radiation thermometer IT 2-50 (manufactured by KEYENCE Corporation) is used to measure the temperature at the center section of the belt. The belt surface temperature is not reduced below 175° C. that is a temperature at which the toner is peeled off from the recording paper in the present embodiment according to FIG. 15. The toner is not peeled off from the recording paper.

Figure 16:
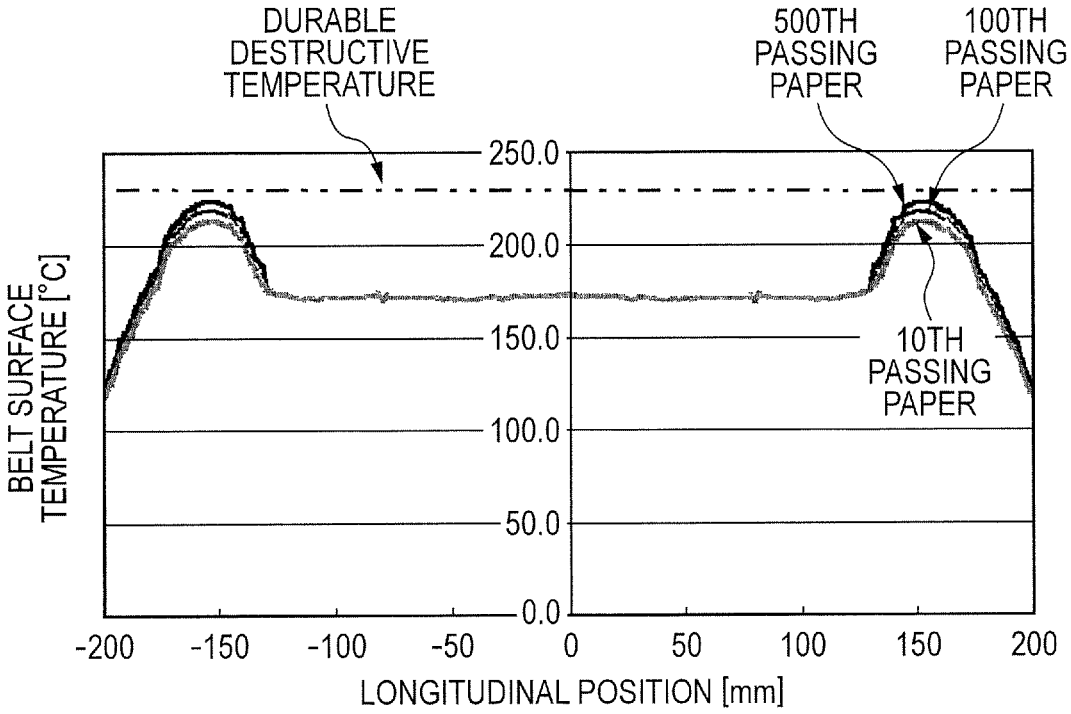
FIG. 16 is a graph illustrating a relationship between the number of passed papers and an increase in the temperature of a paper non-passing section according to the first embodiment.

Next, FIG. 16 illustrates a temperature distribution in the longitudinal direction relative to the number of passed papers when 500 sheets of GF-C 104 (manufactured by Canon Inc.): the recording papers of A4 size are passed in the fixing apparatus 500 of the present embodiment, at 80 ppm and under an environment of temperature 15° C. and humidity 15%.

The infrared thermography FSV-7000S (manufactured by Apiste Corporation) is used to measure the temperature distribution in the longitudinal direction. According to FIG. 16, the risen temperature of the paper non-passing sections is equal to or below 230° C. as the durable destructive temperature even after the number of passed papers is 500, and the increase in the temperature of the paper non-passing sections can be suppressed. If the temperature of the fixing belt rises above the durable destructive temperature, the belt is degraded, and the number of papers than can be passed is significantly reduced.

The following is a summary of the present embodiment. When the recording paper is small-sized recording paper narrower than the large-sized recording paper with the maximum width size that can be used for the apparatus, the control unit 309 controls the core movement unit 65 of the unit 60 as follows. More specifically, among the plurality of divided movable cores 63*a*, the cores corresponding to the paper passing area of the small-sized recording paper to be passed are positioned at the first distance position D, and the other cores are positioned at the second distance position E. The magnetic flux shielding member movement unit 20 controls the magnetic flux shielding plates 10L and 10R to move from the retraction positions to the effective positions.

The control unit 309 controls the heat equalizing member movement unit 90 as follows according to the temperature of the belt 41 detected by the sensor TH at the reception of the recording paper passing job. More specifically, the control unit 309 controls the heat equalizing roller 70 to move from the second position G to the first position F before the first recording paper enters the nip section N when the temperature of the belt 41 detected by the sensor TH at the reception of the recording paper passing job is equal to or higher than the predetermined threshold temperature. The control unit 309 controls the heat equalizing roller 70 to move from the second position G to the first position F after the number of consecutive passed papers counted by the count unit 1003 reaches the predetermined value of the number of papers (set value) when the temperature is lower than the predetermined threshold.

As described, if the fixing apparatus 500 of the present embodiment is used, the increase in the temperature of the paper non-passing sections can be sufficiently prevented even if there are various width sizes of the recording paper P, and a fixing apparatus can be provided in which the toner is not peeled off from the recording paper.

If attachment operation is performed when the recording paper P is across the transfer unit T2 and the fixing unit N in the attachment of the heat equalizing roller 70 during a job, the vibration may cause an image defect such as image deviation in the transfer unit T2. Therefore, ON timing of a fixing entrance sensor S (FIG. 4) that detects arrival of the tip of the recording paper can be detected, and control for the attachment at timing that does not meet the above conditions can be added.

More specifically, when operation of abutting the separated heat equalizing roller is performed during the image formation job, the down time becomes large if passing of the recording paper is stopped. For preventing this, if abutment operation is performed during passing of the paper, the following problem occurs. If the heat equalizing roller is abutted to the object when the recording paper is at a position across the fixing nip section and the transfer nip section, the rotational load of the object increases, and the conveyance property of the recording paper is reduced. Therefore, the conveyance property of the recording paper at the transfer nip section is reduced, and an image defect may occur.

Therefore, the following control is performed in the case of the small-sized recording paper, with the width of the recording paper in the width direction orthogonal to the conveyance direction of the recording paper smaller than the width of the maximum size that can be passed, wherein the length of the recording paper in the conveyance direction is longer than the length between the transfer unit, which transfers images to the recording paper, and the nip section. More specifically, during the execution of an image formation job for continuously passing the recording paper to form images, operation of abutting the heat equalizing roller separated from the pressure roller to the pressure roller is performed after the back end of the recording paper has passed the transfer unit and before the next recording paper reaches the nip section.

More specifically, in the recording paper conveyance path on the upstream of the nip section N in the recording paper conveyance direction, the sensor (recording paper detection unit) S is arranged between a recording paper nipping and conveying unit (the secondary transfer nip section T2 in the present embodiment) closest to the nip section N and the nip section N. The control unit 309 controls the movement of the heat equalizing roller 70 from the second position G to the first position F by the heat equaling member movement unit 90 as follows. More specifically, the control is triggered by a recording paper tip detection signal of the sensor S, and the control is performed when the recording paper P is not nipped with both the recording paper nipping and conveying unit T2 and the nip section N based on the size (dimension in the recording paper conveyance direction a) of the recording paper P during paper passing and based on the conveyance speed.

In addition to the condition, the following conditions can be further provided. The following event may occur when the heat equalizing roller 70 is attached to the pressure roller 50 during the job. More specifically, when the heat on the surface of the pressure roller 50 is taken away from the nip section that is in contact with the heat equalizing roller 70 and when the surface of the pressure roller 50 with lowered temperature nips the recording paper P at the nip section N, a difference in the surface temperature of the pressure roller 50 occurs within one recording paper. Therefore, image coating unevenness may occur. Particularly, this may occur when the temperature of the heat equalizing roller 70 or the temperature of the pressure roller 50 is low, such as the first time in the morning.

Figure 17:
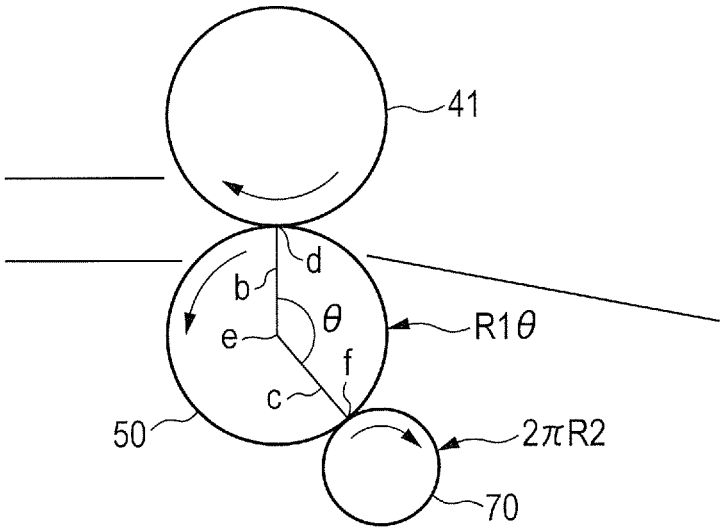
FIG. 17 is an explanatory view of a condition 1 and a condition 2 of timing for abutting the heat equalizing roller to a pressure roller.

Therefore, for the conditions of timing for abutting the heat equalizing roller 70 to the pressure roller 50, both conditions 1 and 2 described below can be satisfied at the same time in addition to the conditions described above to remove the influence of one cycle of the surface of the heat equalizing roller 70 as described in FIG. 17. When the heat equalizing roller 70 circles once while being attached to the pressure roller 50, the heat equalizing roller 70 is heated by heat transfer from the surface of the pressure roller 50. The temperature difference between the pressure roller 50 and the heat equalizing roller 70 is reduced, and an image defect such as coating unevenness does not occur.

Condition 1: The back end of the preceding recording paper P is positioned on the downstream of upstream R1θ (mm) of the nip section N.

Condition 2: The tip of the following recording paper P is positioned on the upstream of upstream R1θ+2πr2 (mm) of the nip section N.

When R1: radius (mm) of the pressure rotary member 50, R2: radius (mm) of the heat equalizing unit (rotary member) 70, θ: angle (rad) formed by a line b and a line c.

The line b denotes a line connecting a contact point d of the heating rotary member 41 and the pressure rotary member 50 (center section in the recording paper conveyance direction a of the nip section N) and a center e of the pressure rotary member 50. The line c denotes a line connecting a contact point f of the pressure rotary member 50 and the heat equalizing unit 70 (center section in the pressure rotary member direction of the nip section that is in contact) and the center e of the pressure rotary member 50.

Second Embodiment

In the first embodiment, the heat equalizing roller 70 is abutted to the pressure roller 50 when the number of passed papers reaches the predetermined number in the first mode in a continuous job for continuously forming images on a plurality of small-sized recording papers. Meanwhile, in the present embodiment, the heat equalizing roller 70 is attached to the pressure roller 50 after detection of the fact that the temperature of the paper non-passing areas of the fixing belt has passed the lowest temperature when the first mode is selected in a continuous job for continuously forming images on a plurality of small-sized recording papers.

When the magnetic flux adjustment unit is operated to execute the job for continuously forming images on the small-sized recording paper, the following is the timing for abutting the heat equalizing roller 70 to the pressure roller 50 when the temperature detected by the temperature sensor TH before the start of image formation (when the print command is received) is lower than a set temperature (80° C. in the present embodiment). More specifically, the timing is delayed from the timing for abutting the heat equalizing roller 70 to the pressure roller 50 when the temperature detected by the temperature sensor TH before the start of the image formation is higher than the set temperature.

If the temperature detected by the temperature sensor TH before the start of the image formation is higher than the set temperature, the magnetic flux adjustment unit is moved to the adjustment position before the start of the image formation (before the image heating process), and operation of abutting the heat equalizing roller 70 to the pressure roller 50 is performed.

If the detected temperature detected by the temperature sensor TH before the start of the image formation is lower than the set temperature, the magnetic flux adjustment unit is moved to the adjustment position before the start of the image formation (before the image heating process), and the operation of abutting the heat equalizing roller 70 to the pressure roller 50 is performed at preset timing after the start of the image formation.

The configuration of the fixing apparatus of the present embodiment is the same as in the first embodiment, and the thermistor (temperature detection element) TH as a temperature sensor is abutted and arranged at a position of a center inner surface section in the width direction of the belt 41. The sensor TH1 can detect the temperature of the belt 41 and measure the lowest temperature of the belt during paper passing. The lowest temperature varies depending on the environment or the paper type. The relationship of the lowest temperature with the environment and the paper type is figured out in preliminary examination, and the information is stored in the memory of the control unit 309. The toners are the same as in the first embodiment.

Figure 18:
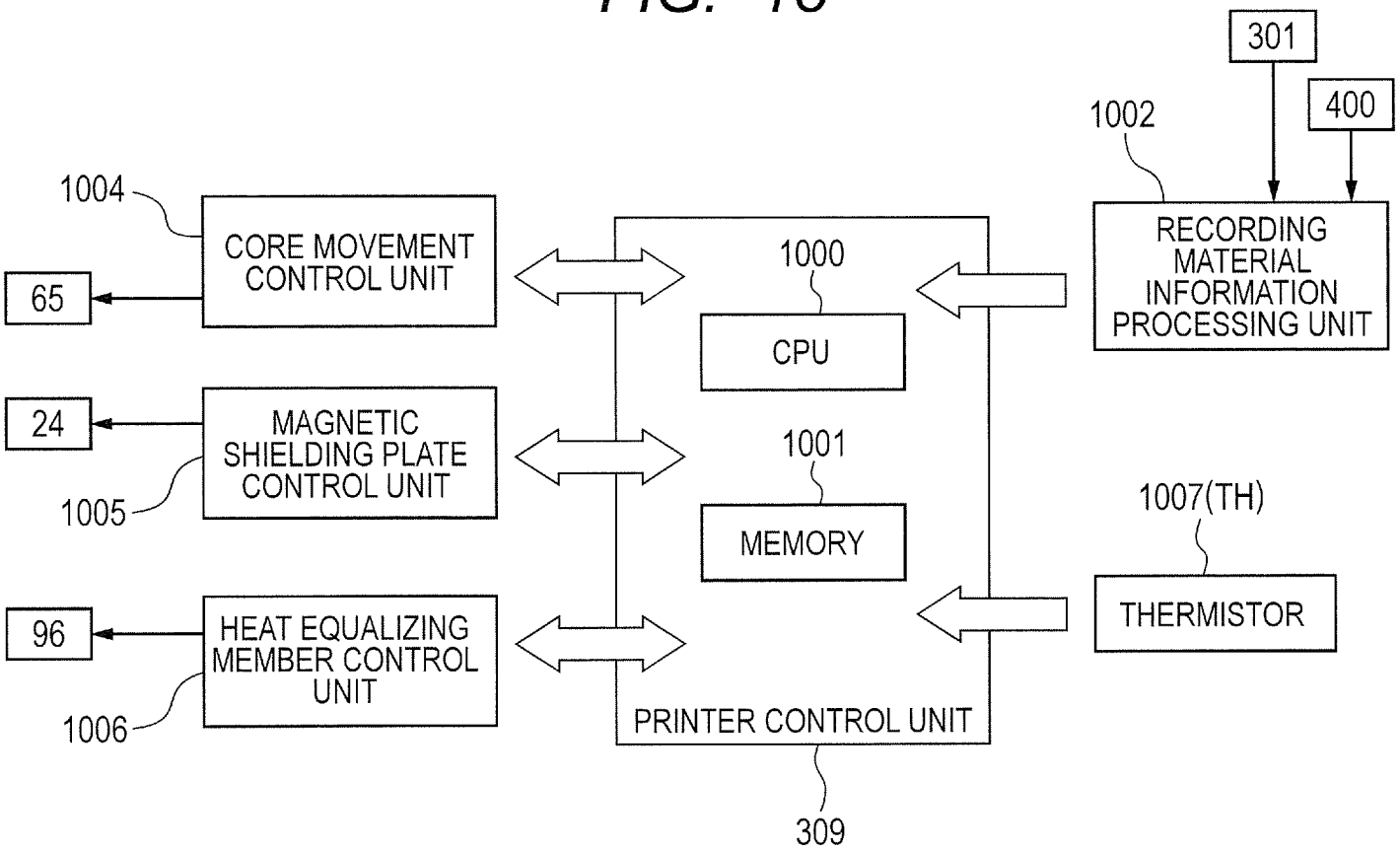
FIG. 18 is a block diagram for illustrating control of a second embodiment.

The control of the present embodiment will be described with reference to a block diagram illustrated in FIG. 18. Information of the type of recording paper (sheet size and sheet type) output by the user is transmitted from the operation unit 301 or the PC (external host apparatus) 400 to the recording paper information processing unit 1002. The information of the recording paper information processing unit 1002 is transferred to the CPU 1000 of the printer control unit 309.

The CPU 1000 refers to the memory 1001 and determines the movement controlled amounts of the cores 63*a* of the unit 60 and the controlled amounts of the magnetic shielding plates 10L and 10R based on the information from the recording paper information processing unit 1002. The core movement controlled amounts and the magnetic shielding member controlled amounts are transferred to the core movement control unit 1004 and the magnetic shielding plate control unit 1005.

The core movement control unit 1004 and the magnetic shielding plate control unit 1005 control the drive units 65 and 24, respectively, to move the cores 63*a* and the magnetic shielding plates 10L and 10R to the predetermined positions. Information of a thermistor 1007 (TH) is transferred to the CPU 1000. Based on the information, the CPU 1000 determines whether the temperature of the belt 41 has passed the lowest temperature by one degree during the job. If the temperature of the belt 41 has passed the lowest temperature by one degree during the job, the CPU 1000 issues an instruction to the heat equalizing member control unit 1006 to drive the drive unit 96 to cause the roller 70 to come into contact with the roller 50.

Figure 19:
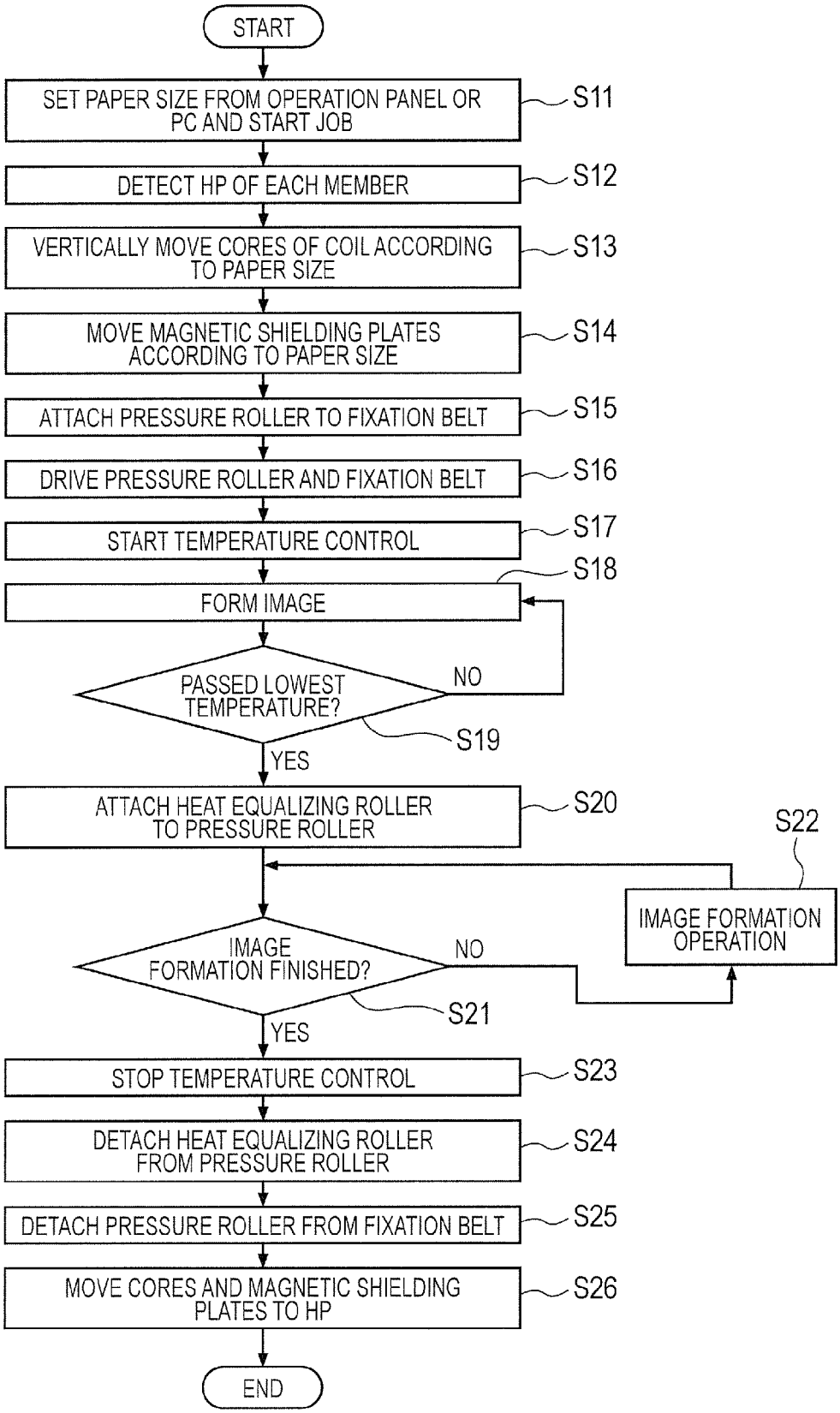
FIG. 19 is a flow chart for illustrating the control of the second embodiment.

FIG. 19 illustrates a control flow chart of the present embodiment. The type (size) of the recording paper P to be passed is first set from the operation panel of the operation unit 301 or the PC (external host apparatus) 400, and a job to be copied or printed is transmitted to the image forming apparatus to start the job (S11). The home positions of the members (the cores 63*a* of the unit 60, the magnetic shielding plates 10L and 10R, the heat equalizing roller 70 and the pressure roller 50) are detected (S12).

The cores 63*a* and the magnetic shielding plates 10L and 10R are moved according to the paper size (S13 and S14). The roller 50 is attached and pressured against the belt 41 to form the nip section N (S15). The roller 50 is rotationally driven to rotate the belt 41 (S16). A current is applied to the coil 62 to cause the belt 41 to generate heat, and the temperature of the belt 41 is controlled (S17). Image formation stations Sa, Sb, Sc and Sd form images for each color, transfer and fix the images on the recording paper, and output the images (S18).

The images are then formed, and the CPU 1000 determines whether the temperature of the belt 41 has passed the lowest temperature within one job (S19). If the temperature of the belt 41 has not passed the lowest temperature even by one degree within one job, the image formation operation is continuously repeated. If the temperature of the belt 41 has passed the lowest temperature by one degree within one job and the temperature of the belt 41 is restored, the roller 70 is attached to the roller 50, and control of suppressing the increase in the temperature of the paper non-passing sections is performed (S20).

The CPU 1000 determines whether the image formation job is finished, and if not, the image formation operation is continuously repeated (S21 and S22). If the image formation job is finished, the current flowing through the coil 62 is cut off, and the temperature control of the belt 41 is stopped (S21 and S23). The heat equalizing roller 70 is detached from the pressure roller 50 (S24). The pressure roller 50 is detached from the fixing belt 41 (S25). The cores 63*a* and the magnetic shielding plates 10L and 10R are moved to the initial positions (home positions), and the job is finished (S26).

Figure 20:
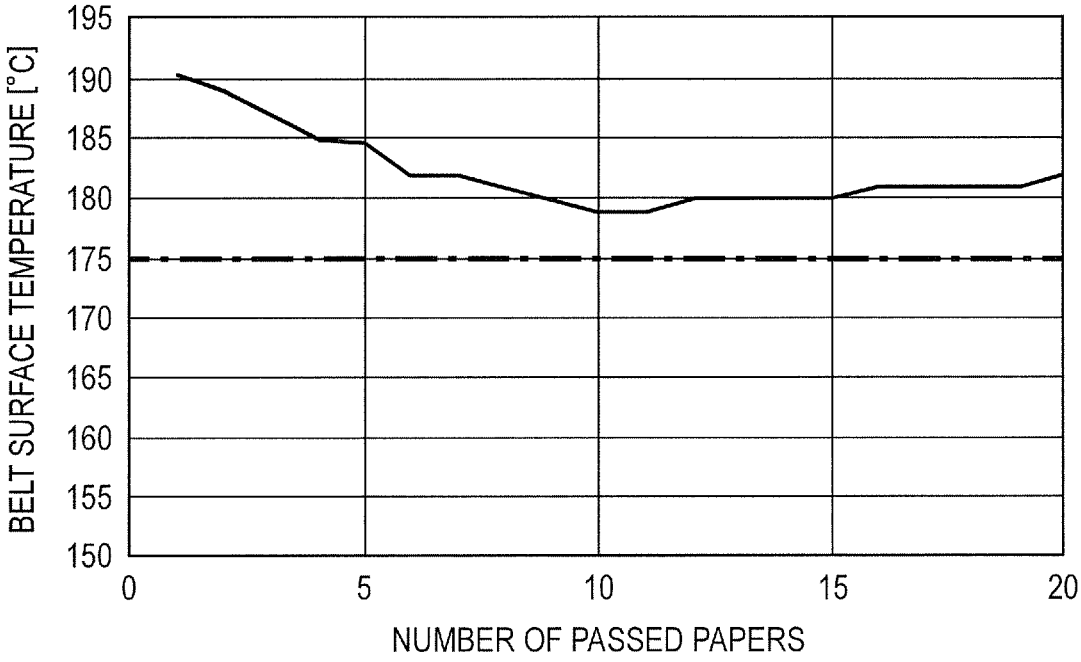
FIG. 20 is a graph of a lowest temperature relative to the number of passed papers for illustrating an effect of the second embodiment.

FIG. 20 illustrates transition of the belt surface temperature relative to the number of passed papers when GF-C 104 (manufactured by Canon Inc.): the recording paper of A4 size is continuously passed in the fixing apparatus of the present embodiment under an environment of temperature 15° C. and humidity 15%. For the belt surface temperature, the infrared radiation thermometer IT 2-50 (manufactured by KEYENCE Corporation) is used to measure the temperature at the center section of the belt. The belt surface temperature is not reduced below 175° C. that is a temperature at which the toner is peeled off from the recording paper in the present embodiment according to FIG. 20. The toner is not peeled off from the recording paper.

Figure 21:
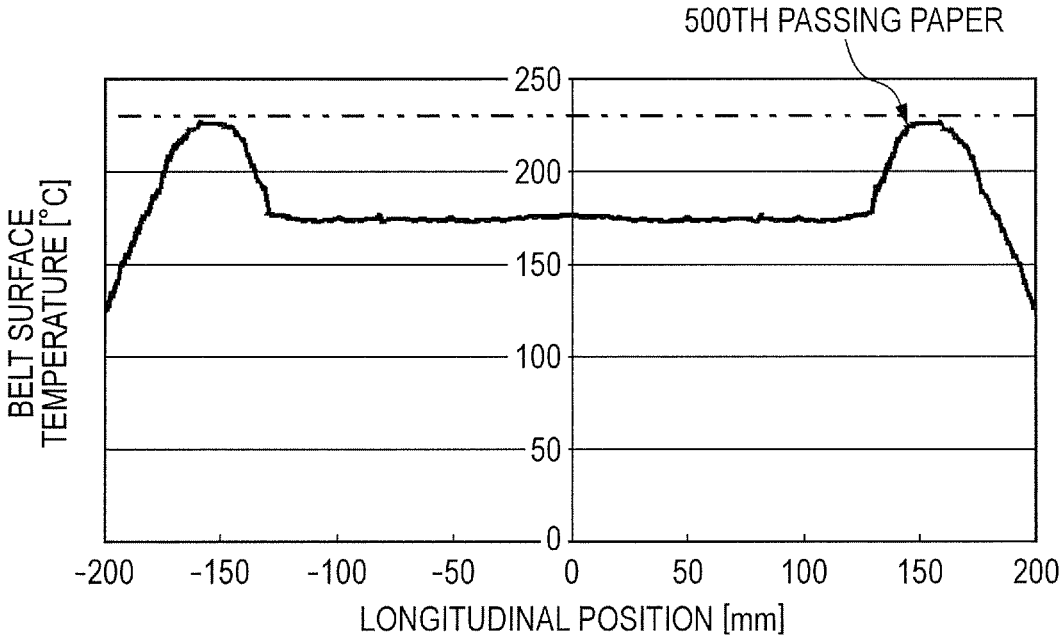
FIG. 21 is a graph of an increase in the temperature of the paper non-passing section according to the second embodiment.

FIG. 21 illustrates a temperature distribution in the longitudinal direction relative to the number of passed papers when 500 sheets of GF-C 104 (manufactured by Canon Inc.): the recording papers of A4 size are passed in the fixing apparatus 500 of the present embodiment, at 80 ppm and under an environment of temperature 15° C. and humidity 15%. The infrared thermography FSV-7000S (manufactured by Apiste Corporation) is used to measure the temperature distribution in the longitudinal direction.

According to FIG. 21, the risen temperature of the paper non-passing sections is equal to or lower than 230° C. as the durable destructive temperature even after the number of passed papers is 500, and the increase in the temperature of the paper non-passing sections can be suppressed. If the temperature of the belt 41 rises above the durable destructive temperature, the belt 41 is degraded, and the number of papers then can be passed is significantly reduced.

In the present embodiment, although the equalizing roller 70 is attached to the pressure roller 50 when the temperature of the belt 41 has passed the lowest temperature, the configuration is not limited to this. For another embodiment, the temperature of the paper non-passing sections of the belt 41 may be detected, and the heat equalizing roller 70 may be attached to the pressure roller 50 based on the temperature information.

In the present embodiment, the control is based on the detected temperature detected by the thermistor TH abutted to the inner surface of the belt 41. For an alternative, a non-contact thermistor which is movable in the longitudinal direction may be arranged outside of the belt 41, and the thermistor may always move in the longitudinal direction during the job. The thermistor may always detect the temperature in the longitudinal direction of the outer peripheral surface of the belt 41, and the heat equalizing roller 70 may be attached to the pressure roller 50 based on the information of the highest temperature.

More specifically, the sensor TH can move back and forth along the longitudinal direction of the belt 41, without touching the belt 41. The sensor TH moves back and forth during the execution of the recording paper passing job and continues detecting the temperature in the longitudinal direction of the belt 41. The control unit 309 controls the heat equalizing member movement unit 90 to move the heat equalizing roller 70 from the second position G to the first position F if the detected temperature input from the sensor TH exceeds a predetermined threshold value.

Figure 22:
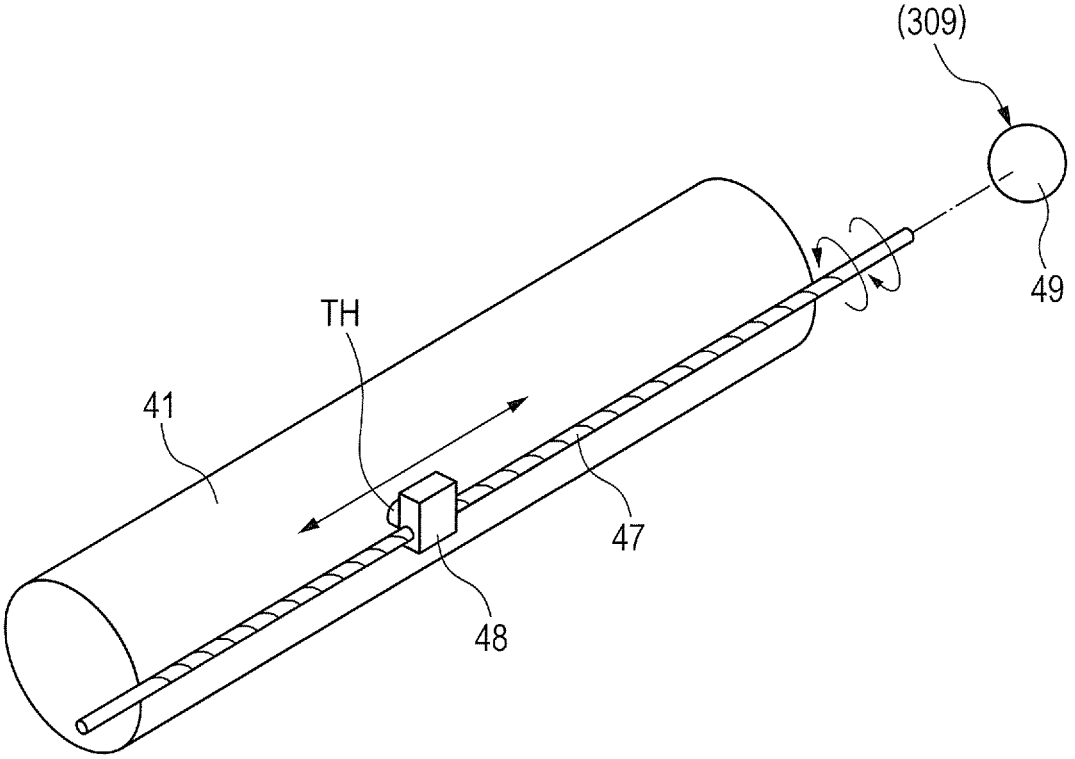
FIG. 22 is a schematic diagram of another configuration example.

FIG. 22 is an outline diagram of a configuration example of the sensor TH. A screw axis 47 is arranged outside of and in parallel with the belt 41. The axis 47 is rotatably arranged through bearings (not illustrated) between the left side plate 30L and the right side plate 30R of the apparatus chassis 30. A carriage 48 that holds the non-contact thermistor TH on the belt 41 is screwed with the axis 47 to be supported by the axis 47. The control unit 309 controls the drive unit 49 to rotationally drive in a forward direction or a reverse direction, and thus the carriage 48 moves back and forth along the axis 47. In this way, the thermistor TH detects the temperature in the longitudinal direction of the outer peripheral surface of the belt in a non-contact manner, and the detection information is input to the control unit 309.

A guide member (not illustrated) holds the posture of the carriage 48 for stable posture during the back and forth movement.

As described, if the fixing apparatus of the present embodiment is used, excessive increase in the temperature of the paper non-passing sections of the fixing belt can be sufficiently prevented if there are a wide variety of sizes in the width direction of the recording paper, and the quick start property can be satisfied.

Other Apparatus Configurations

1) The coil 62 and the core 63 as the magnetic field generation unit 60 can be arranged inside of the fixing belt 41.

2) The pressure roller 50 can be an endless belt body.

3) The image heating apparatus can be applied not only to the fixing apparatus, but can also be effectively applied to a gloss increasing apparatus (image quality improving apparatus) that heats the image fixed on the recording paper to increase the gloss of the image.

Although the embodiments, to which the present invention can be applied, have been described in detail, various devices can be replaced by known configurations within the scope of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-190763, filed Sep. 1, 2011, which is hereby incorporated by reference herein in its entirety.

What is claimed is:

1. An image heating apparatus comprising:

an endless belt that heats a toner image on a recording material at a nip section;

a heater that heats the endless belt;

a drive rotary member that forms the nip section with the endless belt and that rotationally drives the endless belt;

a heat absorption rotary member that absorbs heat from the drive rotary member by abutment with the drive rotary member;

a contact and separation mechanism that contacts the heat absorption rotary member with the drive rotary member and separates the heat absorption rotary member from the drive rotary member; and a controller that controls operation of the contact and separation mechanism, wherein when the image heating apparatus continuously applies an image heating process to a plurality of recording materials narrower than a recording material with a maximum width that is usable with the image heating apparatus, the controller is configured to execute a first mode for abutting the heat absorption rotary member to the drive rotary member after a predetermined number of the recording materials have passed through the nip section, and to execute a second mode for abutting the heat absorption rotary member to the drive rotary member before a first recording material, to which the image heating process is first applied, among the plurality of recording materials, reaches the nip section.

2. The image heating apparatus according to claim 1, further comprising a temperature sensor that detects a temperature of the endless belt, wherein, when an execution command of the image heating process is received, the controller executes the first mode in a case that the temperature detected by the temperature sensor is lower than a predetermined temperature and executes the second mode in a case that the temperature is equal to or higher than the predetermined temperature.

3. The image heating apparatus according to claim 2, wherein, when the execution command of the image heating process is received, the temperature sensor detects the temperature of an area of the endless belt that is farther outside in a width direction than an area contactable with the narrower recording materials.

4. The image heating apparatus according to claim 1, further comprising a counter that counts a number of the recording materials that pass through the nip section, wherein the controller abuts the heat absorption rotary member with the drive rotary member according to the output of the counter in the first mode.

5. The image heating apparatus according to claim 1, wherein thermal conductivity of the heat absorption rotary member is equal to or greater than 100 W/m·K at 100 to 250° C.

6. The image heating apparatus according to claim 1, wherein the heater comprises an exciting coil that heats the endless belt by electromagnetic induction, and a plurality of magnetic cores that are arranged farther from the endless belt than the exciting coil and that are aligned and arranged in a width direction of the endless belt.

7. The image heating apparatus according to claim 6, further comprising:

a magnetic flux suppression member that suppresses a magnetic flux acting on a part of an area of the endless belt farther outside in the width direction than an area where the endless belt is contactable with the recording materials, among the magnetic fluxes extending from the exciting coil to the endless belt; and a movement mechanism that moves the magnetic flux suppression member substantially in the width direction of the endless belt according to a width direction length of the recording materials, wherein the movement mechanism moves the magnetic flux suppression member before the first recording material reaches the nip section in the first mode and the second mode.

8. The image heating apparatus according to claim 6, further comprising a retraction mechanism that retracts at least one of the plurality of magnetic cores in a direction away from the exciting coil according to the width direction length of the recording materials, wherein the retraction mechanism moves the at least one magnetic core before the first recording material reaches the nip section in the first mode and the second mode.

9. The image heating apparatus according to claim 1, wherein, when executing the first mode, the controller abuts the heat absorption rotary member to drive rotary member before a last recording material among the predetermined number of the recording materials passes through the nip section and a recording material subsequent to the last recording material reaches the nip section.

10. An image heating apparatus comprising:

an endless belt that heats a toner image on a recording material at a nip section;

a heater that heats the endless belt;

a drive rotary member that forms the nip section with the endless belt and that rotationally drives the endless belt;

a heat absorption rotary member that absorbs heat from the drive rotary member by abutment with the drive rotary member;

a contact and separation mechanism that contacts the heat absorption rotary member with the drive rotary member and separates the heat absorption rotary member from the drive rotary member; and a controller that controls the operation of the contact and separation mechanism, wherein when the image heating apparatus continuously applies an image heating process to a plurality of recording materials narrower than a recording material with a maximum width that is usable with the image heating apparatus, the controller is configured to execute a first mode for abutting the heat absorption rotary member to the drive rotary member after warm-up processing, and to execute a second mode for causing the heat absorption rotary member to be in a state where the heat absorption rotary member abuts to the drive rotary member during the warm-up processing.

11. The image heating apparatus according to claim 10, further comprising a temperature sensor that detects a temperature of the endless belt, wherein, when an execution command of the image heating process is received, the controller executes the first mode in a case that the temperature detected by the temperature sensor is lower than a predetermined temperature and executes the second mode in a case that the temperature is equal to or higher than the predetermined temperature.

12. The image heating apparatus according to claim 11, wherein, when the execution command of the image heating process is received, the temperature sensor detects the temperature of an area of the endless belt more outside in a width direction than an area contactable with the narrower recording materials.

13. The image heating apparatus according to claim 12, wherein thermal conductivity of the heat absorption rotary member is equal to or greater than 100 W/m·K at 100 to 250° C.

14. The image heating apparatus according to claim 12, wherein the heater comprises an exciting coil that heats the endless belt by electromagnetic induction, and a plurality of magnetic cores that are arranged farther from the endless belt than the exciting coil and that are aligned and arranged in a width direction of the endless belt.

15. The image heating apparatus according to claim 14, further comprising:

a magnetic flux suppression member that suppresses a magnetic flux acting on a part of an area of the endless belt farther outside in the width direction than an area where the endless belt is contactable with the recording materials, among the magnetic fluxes extending from the exciting coil to the endless belt; and a movement mechanism that moves the magnetic flux suppression member substantially in the width direction of the endless belt according to a width direction length of the recording materials, wherein the movement mechanism moves the magnetic flux suppression member before a first recording material, to which the image heating process is first applied, among the plurality of recording materials, reaches the nip section in the first mode and the second mode.

16. The image heating apparatus according to claim 14, further comprising a retraction mechanism that retracts at least one of the plurality of magnetic cores in a direction away from the exciting coil according to the width direction length of the recording materials, wherein the retraction mechanism moves the at least one magnetic core before a first recording material, to which the image heating process is first applied, among the plurality of recording materials, reaches the nip section in the first mode and the second mode.

17. The image heating apparatus according to claim 11, wherein the controller controls the timing of abutting the heat absorption rotary member to the drive rotary member in the first mode according to the output of the temperature sensor.

18. The image heating apparatus according to claim 17, wherein, when a job is received, the temperature sensor detects an area of the endless belt farther outside in the width direction than an area contactable with the narrower recording materials.

19. The image heating apparatus according to claim 10, further comprising a counter that counts a number of the recording materials that pass through the nip section, wherein the controller controls the timing of abutting the heat absorption rotary member to the drive rotary member in the first mode according to the output of the counter.

20. An image heating apparatus comprising:

an endless belt that heats a toner image on a recording material at a nip section;

a heater that heats the endless belt;

a drive rotary member that forms the nip section with the endless belt and that rotationally drives the endless belt;

a temperature sensor that detects temperature of the endless belt;

a heat absorption rotary member that absorbs heat from the drive rotary member by abutment with the drive rotary member;

a contact and separation mechanism that contacts the heat absorption rotary member with the drive rotary member and separates the heat absorption rotary member from the drive rotary member; and a controller that controls operation of the contact and separation mechanism, wherein when the image heating apparatus continuously applies an image heating process to a plurality of recording materials narrower than a recording material with a maximum width that is usable with the image heating apparatus, the controller is configured to execute a first mode for controlling the timing of abutting the heat absorption rotary member to the drive rotary member according to output of the temperature sensor after a first recording material, to which the image heating process is first applied, among the plurality of recording materials, reaches the nip section, and to execute a second mode for abutting the heat absorption rotary member to the drive rotary member before the first recording material, to which the image heating process is first applied, among the plurality of recording materials, reaches the nip section.

21. The image heating apparatus according to claim 20, wherein, when an execution command of the image heating process is received, the controller executes the first mode in a case that the temperature detected by the temperature sensor is lower than a predetermined temperature and executes the second mode in a case that the temperature is equal to or higher than the predetermined temperature.

* * * * *